US008382580B2

(12) United States Patent
Tanimura et al.

(10) Patent No.: US 8,382,580 B2
(45) Date of Patent: Feb. 26, 2013

(54) GAMING MACHINE WITH SEPARATELY SETTABLE AUXILIARY DISPLAY

(75) Inventors: Tatsuhiko Tanimura, Tokyo (JP); Takashi Abe, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 282 days.

(21) Appl. No.: 12/825,741

(22) Filed: Jun. 29, 2010

(65) Prior Publication Data

US 2011/0014970 A1 Jan. 20, 2011

(30) Foreign Application Priority Data

Jul. 14, 2009 (JP) ..... 2009-166144

(51) Int. Cl.
*A63F 9/24* (2006.01)

(52) U.S. Cl. ..... 463/24; 463/31; 463/46

(58) Field of Classification Search ..... 463/24, 463/31, 46

See application file for complete search history.

(56) References Cited

U.S. PATENT DOCUMENTS 6,604,999 B2 8/2003 Ainsworth
2002/0065124 A1 5/2002 Ainsworth

*Primary Examiner* — Milap Shah
*Assistant Examiner* — Lawrence Galka
(74) *Attorney, Agent, or Firm* — Edwards Wildman Palmer LLP

(57) ABSTRACT

A gaming machine includes a light emitting portion, a terminal controller, a light emission control unit, a power supply unit, an input device through which a predetermined input is externally input, and a light emission power control unit. The light emitting portion emits light. The terminal controller runs a game. The light emission control unit causes: with power supplied thereto, the light emitting portion to emit light; and controls the light emitting portion so that the light emitting portion emits light in a lighting mode associated with a game state. The power supply unit supplies power to the light emission control unit and the terminal controller, separately. The light emission power control unit controls, in response to the predetermined input, the power supply from the power supply unit to the light emission control unit in a resettable manner, while terminal controller is running the game.

3 Claims, 19 Drawing Sheets

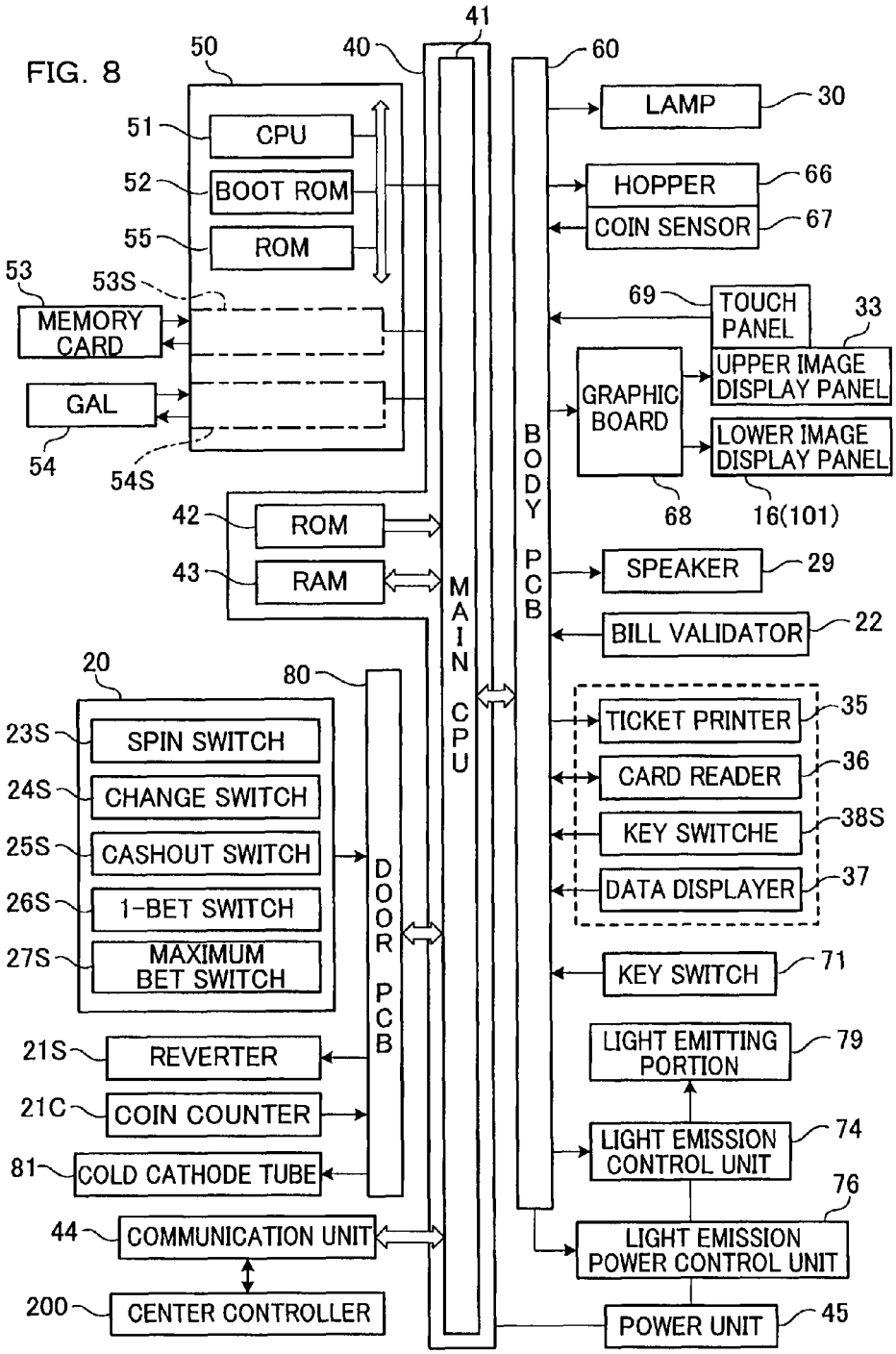
FIG. 8
50
40
41
60
51
CPU
52
BOOT ROM
55
ROM
53
53S
MEMORY CARD
GAL
54
54S
42
ROM
43
RAM
MAIN CPU
BODY PCB
LAMP
30
HOPPER
66
COIN SENSOR
67
69
TOUCH PANEL
33
GRAPHIC BOARD
UPPER IMAGE DISPLAY PANEL
LOWER IMAGE DISPLAY PANEL
68
16(101)
SPEAKER
29
BILL VALIDATOR
22
20
80
23S
SPIN SWITCH
24S
CHANGE SWITCH
25S
CASHOUT SWITCH
26S
1-BET SWITCH
27S
MAXIMUM BET SWITCH
DOOR PCB
TICKET PRINTER
35
CARD READER
36
KEY SWITCHE
38S
DATA DISPLAYER
37
KEY SWITCH
71
21S
REVERTER
21C
COIN COUNTER
81
COLD CATHODE TUBE
LIGHT EMITTING PORTION
79
LIGHT EMISSION CONTROL UNIT
74
76
LIGHT EMISSION POWER CONTROL UNIT
44
COMMUNICATION UNIT
200
CENTER CONTROLLER
POWER UNIT
45

FIG. 10

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE NO. | SYMBOL | SYMBOL | SYMBOL | SYMBOL | SYMBOL |
| 00 | ANGELFISH | TUNA | TUNA | COELACANTH | CLOWNFISH |
| 01 | CLOWNFISH | COELACANTH | TUNA | ANGELFISH | TUNA |
| 02 | ANGELFISH | TUNA | ANGELFISH | CLOWNFISH | ANGELFISH |
| 03 | CLOWNFISH | COELACANTH | TUNA | BONUS | COELACANTH |
| 04 | ANGELFISH | TUNA | ANGELFISH | COELACANTH | CLOWNFISH |
| 05 | CLOWNFISH | ANGELFISH | CLOWNFISH | CLOWNFISH | 7 |
| 06 | ANGELFISH | CLOWNFISH | ANGELFISH | TUNA | ANGELFISH |
| 07 | CLOWNFISH | TUNA | CLOWNFISH | 7 | TUNA |
| 08 | 7 | COELACANTH | ANGELFISH | CLOWNFISH | CLOWNFISH |
| 09 | TUNA | TUNA | CLOWNFISH | ANGELFISH | COELACANTH |
| 10 | ANGELFISH | COELACANTH | ANGELFISH | COELACANTH | TUNA |
| 11 | COELACANTH | BONUS | CLOWNFISH | ANGELFISH | CLOWNFISH |
| 12 | ANGELFISH | CLOWNFISH | COELACANTH | CLOWNFISH | COELACANTH |
| 13 | BONUS | 7 | BONUS | TUNA | ANGELFISH |
| 14 | 7 | COELACANTH | 7 | TUNA | TUNA |
| 15 | ANGELFISH | TUNA | COELACANTH | BONUS | CLOWNFISH |
| 16 | TUNA | COELACANTH | TUNA | TUNA | TUNA |
| 17 | CLOWNFISH | BONUS | CLOWNFISH | COELACANTH | ANGELFISH |
| 18 | ANGELFISH | CLOWNFISH | ANGELFISH | CLOWNFISH | COELACANTH |
| 19 | CLOWNFISH | TUNA | CLOWNFISH | ANGELFISH | ANGELFISH |
| 20 | 7 | COELACANTH | ANGELFISH | TUNA | CLOWNFISH |
| 21 | TUNA | TUNA | CLOWNFISH | CLOWNFISH | BONUS |

FIG. 11

PATH UNIT TABLE

| PATH UNIT | NUMBER OF LIGHT EMITTING PORTIONS |
|---|---|
| PATH UNIT 401a | 100 |
| PATH UNIT 401b | 110 |
| PATH UNIT 401c | 120 |
| ..... | ..... |
| PATH UNIT 401j | 100 |

FIG. 12

PATH UNIT ACTIVATION STATE TABLE

| PATH UNIT | NUMBER OF ACTIVATED LIGHT EMITTING PORTIONS | NUMBER OF LIGHT EMITTING PORTIONS YET TO BE ACTIVATED | NUMBER OF ACHIEVED WINNINGS | NUMBER OF POTENTIAL WINNINGS |
|---|---|---|---|---|
| PATH UNIT 401a | 10 | 90 | 1 | 4 |
| PATH UNIT 401b | 0 | 110 | 0 | 5 |
| PATH UNIT 401c | 100 | 20 | 4 | 1 |
| ..... | ..... | ..... | ..... | ..... |
| PATH UNIT 401j | 30 | 70 | 1 | 4 |

FIG. 13

LIGHT EMITTING PORTION CONTROL TABLE

| IDENTIFICATION INFORMATION | STATE OF LIGHT EMITTING ELEMENTS |
|---|---|
| 001 | 00000000000・・・ |
| 002 | 11111111111・・・ |
| 003 | 01010101010・・・ |
| 004 | 10101010101・・・ |
| ・・・ | ・・・ |

FIG. 14

LIGHTING MODE INSTRUCTION TABLE

| STATE OF GAME | LIGHTING MODE |
|---|---|
| IDLE | "003, 1000"、"004, 1000" |
| PAYOUT AWARDED | "001, 200"、"002, 200" |
| ・・・ | ・・・ |

GAMING MACHINE WITH SEPARATELY SETTABLE AUXILIARY DISPLAY

CROSS REFERENCE TO RELATED APPLICATION

The present application claims priority from Japanese Patent Application No. 2009-166144, which was filed on Jul. 14, 2009, the disclosure of which is herein incorporated by reference in its entirety.

BACKGROUND OF THE INVENTION

1. Field of the Invention

The present invention relates to a gaming machine having a light emitting device capable of controlling power supply.

2. Description of Related Art

A known slot machine is configured so that, when a player inserts a game value such as a coin or a piece of paper money into an insertion slot of the slot machine and then operates a spin button, a plurality of symbols are scroll-displayed on a display provided on a front face of a cabinet, and then the symbols automatically stop.

Such a gaming machine pays out a predetermined number of game media when the symbols displayed on a winning line form a predetermined combination, as disclosed in U.S. Pat. No. 6,604,999B2 and U.S. Patent Publication No. 2002065124A1, for example.

Such a gaming machine is provided with a light emitting device capable of changing its display modes in accordance with gaming states, to improve an entertainment characteristic of the gaming machine.

In the case of an error in a program which controls the light emitting device as described above, the light emitting device may emit light in an abnormal lighting mode. This will require resetting a control substrate of the light emitting device by rebooting the gaming machine itself to enable a normal lighting operation in the light emitting device to maintain the entertainment characteristic. Rebooting such a gaming machine, however, requires halting the game in progress, and this reboot tends to discourage a player from playing a game at the gaming machine.

Further, the gaming machine as described above may have a plurality of parameters and the like in order to offer an advantageous game state. Rebooting such a gaming machine does not allow retention of the parameters and the like until after the reboot has been completed. This tends to decrease the credibility of the gaming machine with the player, and result in deterioration in the entertainment characteristic.

Further, even when such parameters are retained in a flash memory or the like, it is not possible to inform a player accordingly. This may cause the player an uneasy feeling, thus possibly deteriorating the entertainment characteristic.

Accordingly, the object of the present invention is to provide a gaming machine which prevents deterioration in an entertainment characteristic caused by an error in a light emitting device.

SUMMARY OF THE INVENTION

The present invention is a gaming machine which includes a light emitting portion, a game controller, a light emission control unit, a power supply unit, an input device through which a predetermined input can be externally inputted, and a light emission power control unit. The light emitting portion emits light with power. The game controller runs a game with power supplied thereto. The light emission control unit causes the light emitting portion to emit light, and controls the light emitting portion so that the light emitting portion emits light in a lighting mode associated with a game state. The power supply unit supplies power to the light emission control unit and the game controller, separately. The light emission power control unit controls power supply from the power supply unit to the light emission control unit in a resettable manner, in response to the predetermined input, while the game controller is running the game.

According to the above structure, power supply to the light emission control unit is resettable while a game is in progress. Thus, the light emission control unit can be reset without halting the game, even when an error occurs in the light emitting portion or the light emission control unit. Thus, it is possible to show a player who plays a game that the gaming machine is capable of resetting the light emission control unit alone, while retaining data and the like kept by the gaming machine. This prevents decrease in the credibility of the gaming machine and an administrator thereof with a player.

Further, the present invention is a gaming machine which includes a light emitting portion, a game controller, a light emission control unit, a power supply unit, an input device through which an input can be externally inputted, a light emission power control unit, and a detection unit. The light emitting portion emits light with power. The game controller runs a game with power supplied thereto. The light emission control unit causes the light emitting portion to emit light, and controls the light emitting portion so that the light emitting portion emits light in a lighting mode associated with a game state. The power supply unit supplies power to the light emission control unit and the game controller, separately. The light emission power control unit controls power supply from the power supply unit to the light emission control unit in a resettable manner in response to the predetermined input, while the game controller is running the game. The detection unit detects a lighting mode of the light emitting portion. In the gaming machine, the gaming controller determines if the lighting mode detected by the detection unit differs from the lighting mode associated with the game state. If the former lighting mode differs from the latter one, the game controller instructs the light emission power control unit to reset power supply.

According to the above structure, power supply to the light emission control unit is resettable while a game is in progress. Thus, the light emission control unit can be reset without halting the game, even when an error occurs in the light emitting portion or the light emission control unit. Thus, it is possible to show a player who plays a game that the gaming machine is capable of resetting the light emission control unit alone, while retaining data and the like held by the gaming machine. This prevents decrease in credibility of the gaming machine and the administrator thereof with a player. Further, the actual lighting mode is detected and when it is determined that the actual lighting mode differs from a lighting mode associated with a game state, the power supply to the light emission control unit is reset. Accordingly, it is possible to automatically rectify an error in the light emitting portion. As a result, it is possible to prevent deterioration in the entertainment characteristic caused by an error in a light emitting device.

Further, the present invention is the gaming machine described above, where the light emission control unit is capable of controlling the light emitting portion so that the light emitting portion emits light in a predetermined lighting mode, when no power is supplied from the power supply unit to the game controller.

According to the above structure, even when no power is supplied to the game controller, it is possible to control the light emitting portion so that the light emitting portion emits light in the predetermined lighting mode. This allows the power supply to the game controller to be shut down, which results in power saving on the gaming machine. Further, controlling the light emitting portion so that it emits light in a predetermined lighting mode facilitates retention of an entertainment characteristic of a game arcade or the like in which the gaming machine is installed.

The present invention is capable of preventing deterioration in the entertainment characteristic.

BRIEF DESCRIPTION OF THE DRAWINGS

FIG. 8 is a block diagram of an electrical structure of the gaming terminal.

FIG. 10 is an explanatory diagram of a symbol column of symbols to be rearranged on a terminal display.

FIG. 11 illustrates a path unit table.

FIG. 12 illustrates a path unit activation state table.

FIG. 13 illustrates a light emitting portion control table.

FIG. 14 illustrates a lighting mode instruction table.

DESCRIPTION OF THE PREFERRED EMBODIMENTS

Gaming Machine Overview

Figure 1:
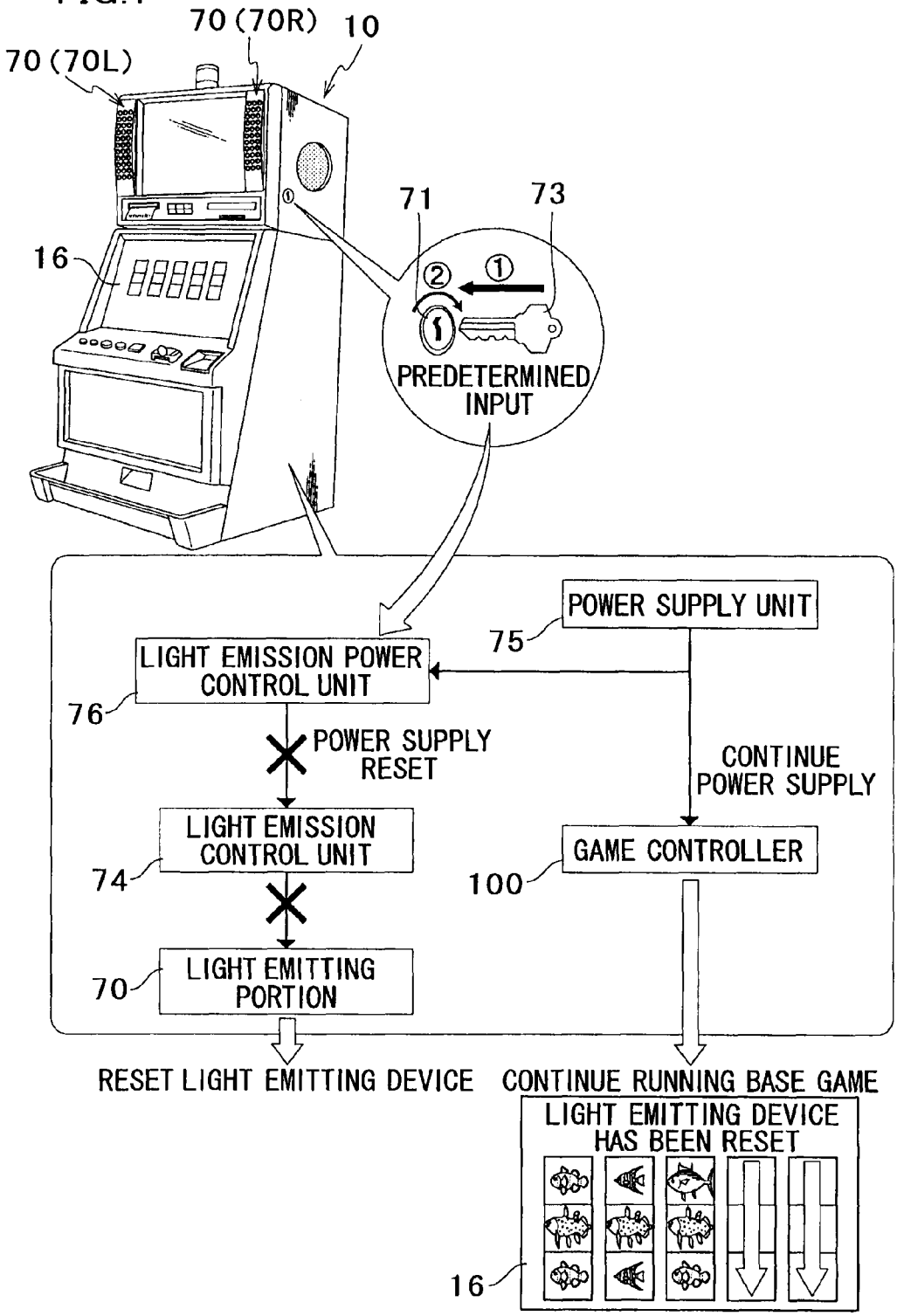
FIG. 1 is an explanatory diagram of an operation of a gaming machine.

A gaming machine includes a plurality of gaming terminals each of which is capable of independently running a base game. The gaming terminals each include a light emitting portion and an input device. The light emitting portion is controlled so that it emits light in a lighting mode associated with the base game. The input device is capable of resetting the light emitting portion while the base game is in progress.

Specifically, in a gaming machine 1, slot machines 10 each provided as a gaming terminal independently run a base game with a terminal controller 100 serving as a game controller, and the slot machines 10 each cause a light emission control unit 74 to control a light emitting portion 79 so that the light emitting portion 79 emits light in a lighting mode associated with a game state of the base game. The gaming machine 1 is configured in such a manner that each slot machine 10 performs power supply to the terminal controller 100 for running the base game and power supply for controlling the light emitting portion 79 separately from each other. The gaming machine 1 is further configured in such a manner that the power supply for controlling the light emitting portion 79 is resettable in response to a predetermined input externally inputted through the input device provided to the slot machine 10.

In other words, the gaming machine 1 has a first structure where the gaming machine 1 includes a light emitting portion 79, a terminal controller 100, a light emission control unit 74, a power supply unit 75, an input device through which a predetermined input can be externally inputted, and a light emission power control unit 76. The light emitting portion 79 emits light with power. The terminal controller 100 runs a game with power supplied thereto. The light emission control unit 74: causes, with power supplied thereto, the light emitting portion 79 to emit light; and controls the light emitting portion 79 so that the light emitting portion 79 emits light in a lighting mode associated with a game state. The power supply unit 75 supplies power to the light emission control unit 74 and the terminal controller 100, separately. The light emission power control unit 76 controls, in response to the predetermined input, the power supply from the power supply unit 75 to the light emission control unit 74 in a resettable manner, while the terminal controller 100 is running the game.

In the present invention, the light emitting portion 79 has a plurality of light emitting elements 79*a* provided to form a matrix. The light emission control unit 74 controls turning on and off of each light emitting element 79*a* to cause the light emitting portion 79 to emit light in various lighting modes. However, display modes of the light emitting portion 79 are not limited thereto. Further, each light emitting element 79*a* is a single-colored LED (light emitting diode); however, the light emitting elements 79*a* are not limited to LEDs.

Figure 4:
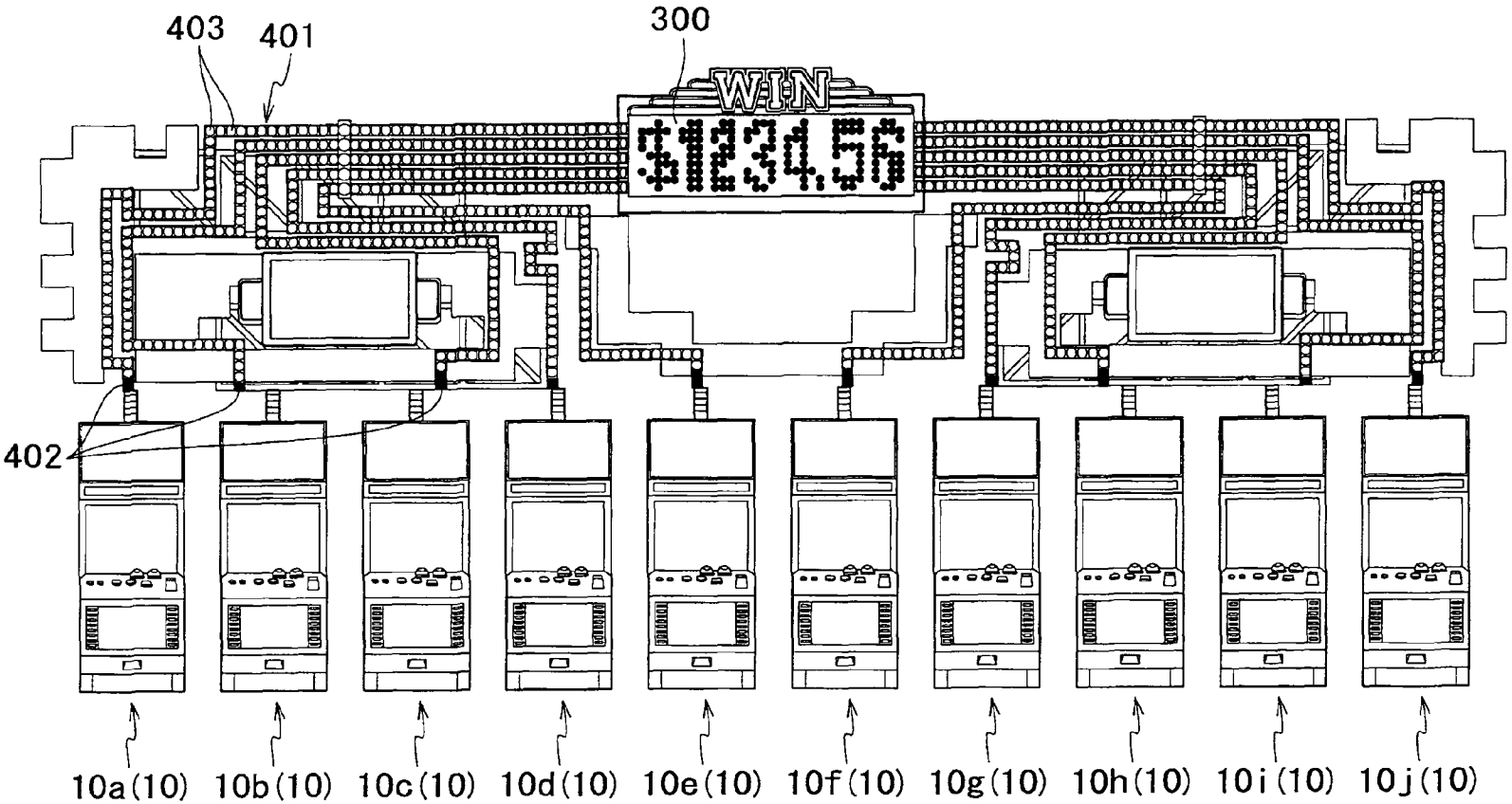
FIG. 4 is a front view of exterior of the gaming machine.
Figure 5:
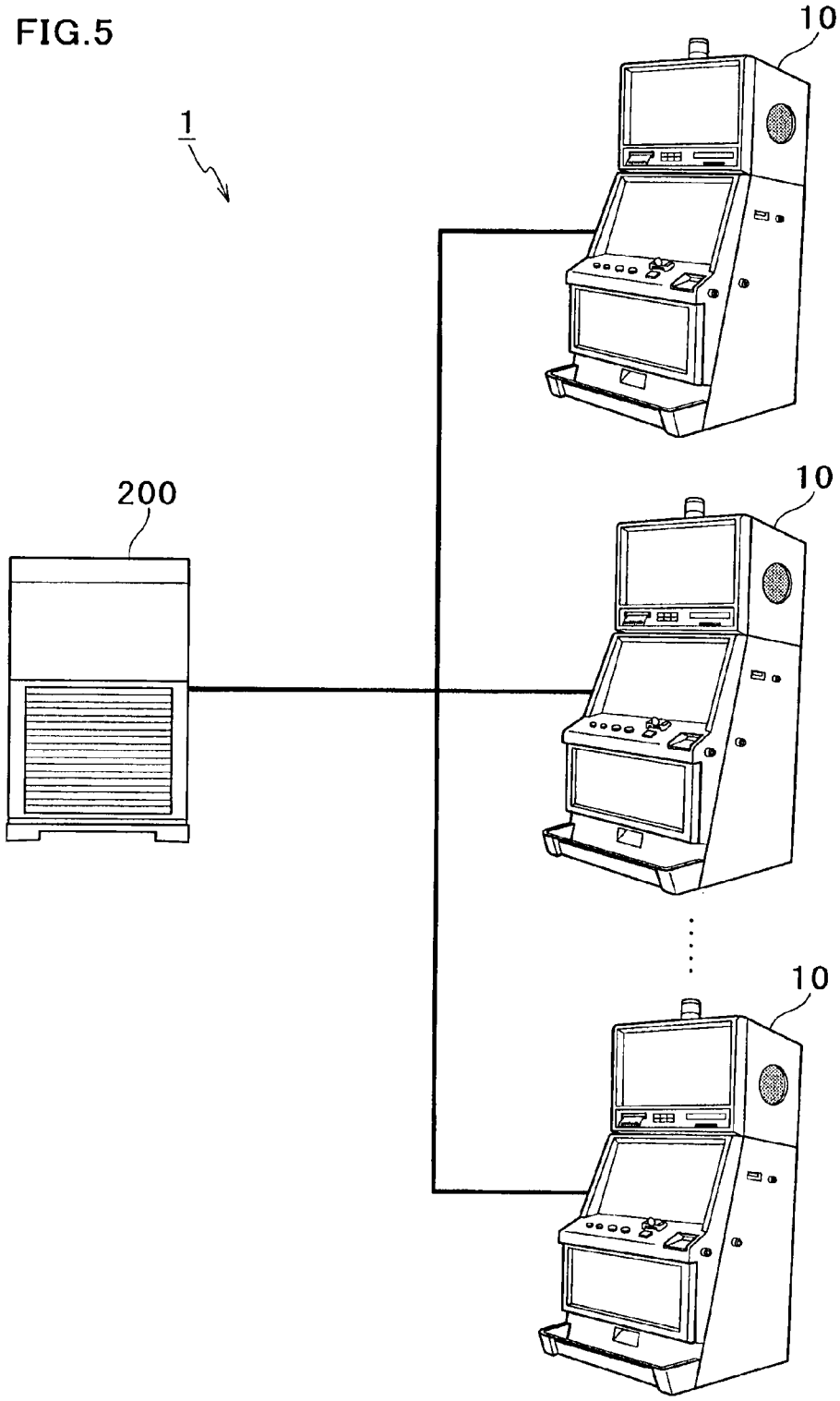
FIG. 5 is a perspective view of the entire gaming machine.

The gaming machine 1 has a multi-player type structure, where slot machines 10 each provided as a gaming terminal are connected in communication with a center controller 200, as illustrated in FIGS. 4 and 5. Thus, the gaming machine 1 is capable of running a common game in which each slot machine 10 can participate. Note that the common game is also referred to as bonus game.

Further, in the present invention, the terminal controller 100 of each slot machine 10 in the gaming machine 1 serves as a game controller; however, the game controller is not limited to this. For instance, the center controller 200 may serve as a game controller, and control the light emitting portion 79 of each slot machine 10 so that the light emitting portion 79 emits light in a display mode based on the common game. Further, the terminal controller 100 and the center controller 200 each may serve as a game controller, and control the display mode of the light emitting portion 79 based on the base game and the common game.

The present embodiment deals with the gaming machine 1 having a center controller 200 aside from the slot machines 10; however, the present invention is not limited to this. In other words, the gaming machine 1 may be configured in such a manner that at least one slot machine 10 has a function of the center controller 200, and the slot machines 10 may be connected in communication with each other. Further, a slot machine 10 which performs a stand-alone operation may serve as the gaming machine 1.

The slot machines 10 each are a type of gaming terminal in the gaming machine 1. Note that the present invention is described using slot machines 10 each as an example of a gaming terminal; however, the present invention is not limited to this: The present invention may adopt a model which has a terminal controller capable of independently running some base game.

The "base game" in the present invention is run by the slot machines 10. The base game is a slot game where a plurality of symbols are arranged. Note that the base game is not limited to the slot game: The base game may be any type of game as long as it is independently runnable at a gaming terminal such as a slot machine 10.

Figure 6:
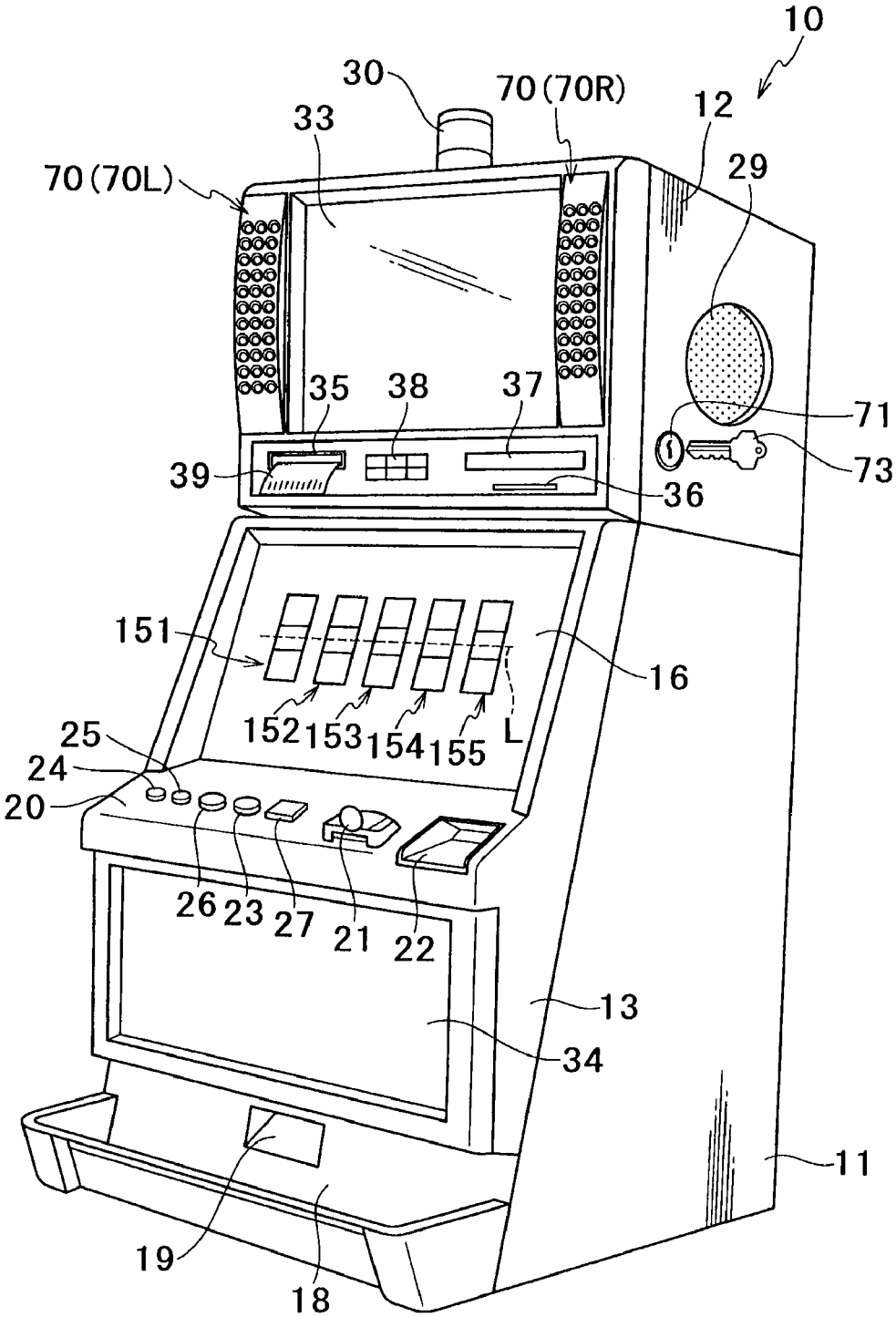
FIG. 6 is a perspective view of an external view of a gaming terminal

As illustrated in FIG. 6, the terminal display 101 has a plurality of arrangement areas 150 in which a plurality of symbols are arranged in the base game.

The "arranging" means a state where the symbols can be visually observed by a player. That is, the arranging in FIG. 6 means a state where the symbols are displayed in the arrangement areas 150. Arranging the symbols after releasing its arrangement is referred to as "rearranging."

The terminal display 101 may have a mechanical configuration with a reel device which rotates a reel to arrange the symbols. Alternatively, the terminal display 101 may have an electrical configuration where the symbols are arranged on a video reel displayed as an image. Further, the terminal display 101 may adopt a combination of the mechanical configuration (reel) and the electrical configuration (video reel). Examples of the electrical configuration include a liquid crystal display device, a CRT (cathode-ray tube) device, and a plasma display device. Further, the number of arrangement areas 150 is not limited. A specific structure of the terminal display 101 will be detailed later.

According to the gaming machine 1 having the first structure, it is possible to reset the power supplied to the light emission control unit 74 while the game is in progress, and the light emission control unit 74 is resettable without halting the game even when an error occurs in the light emitting portion 79 or the light emission control unit 74. Thus, it is possible to show a player who plays a game that the gaming machine 1 is capable of resetting the light emission control unit 74 alone, while retaining data and the like held by the gaming machine 1. This prevents decrease in credibility of the gaming machine 1 and the administrator thereof with a player. As a result, it is possible to prevent deterioration in the entertainment characteristic caused by an error in a light emitting device.

Further, in addition to the first structure, the gaming machine 1 may have a second structure where the light emission control unit 74 is capable of controlling the light emitting portion 79 so that the light emitting portion 79 emits light in a predetermined lighting mode, when the power supply unit 75 is not supplying power from the terminal controller 100.

Thus, according to the second structure, the light emitting portion 79 can be controlled by the light emission control unit 74 such that the light emitting portion 79 emits light in the predetermined lighting mode, even when no power is supplied to the game controller. This allows the power supply to the game controller 100 to be shut down, which results in power saving on the gaming machine 1. Further, controlling the light emitting portion 79 so that it emits light in the predetermined lighting mode facilitates retention of an entertainment characteristic of a game arcade or the like in which the gaming machine 1 is installed.

(Functional Block of Gaming Machine 1: Slot Machine)

Figure 2:
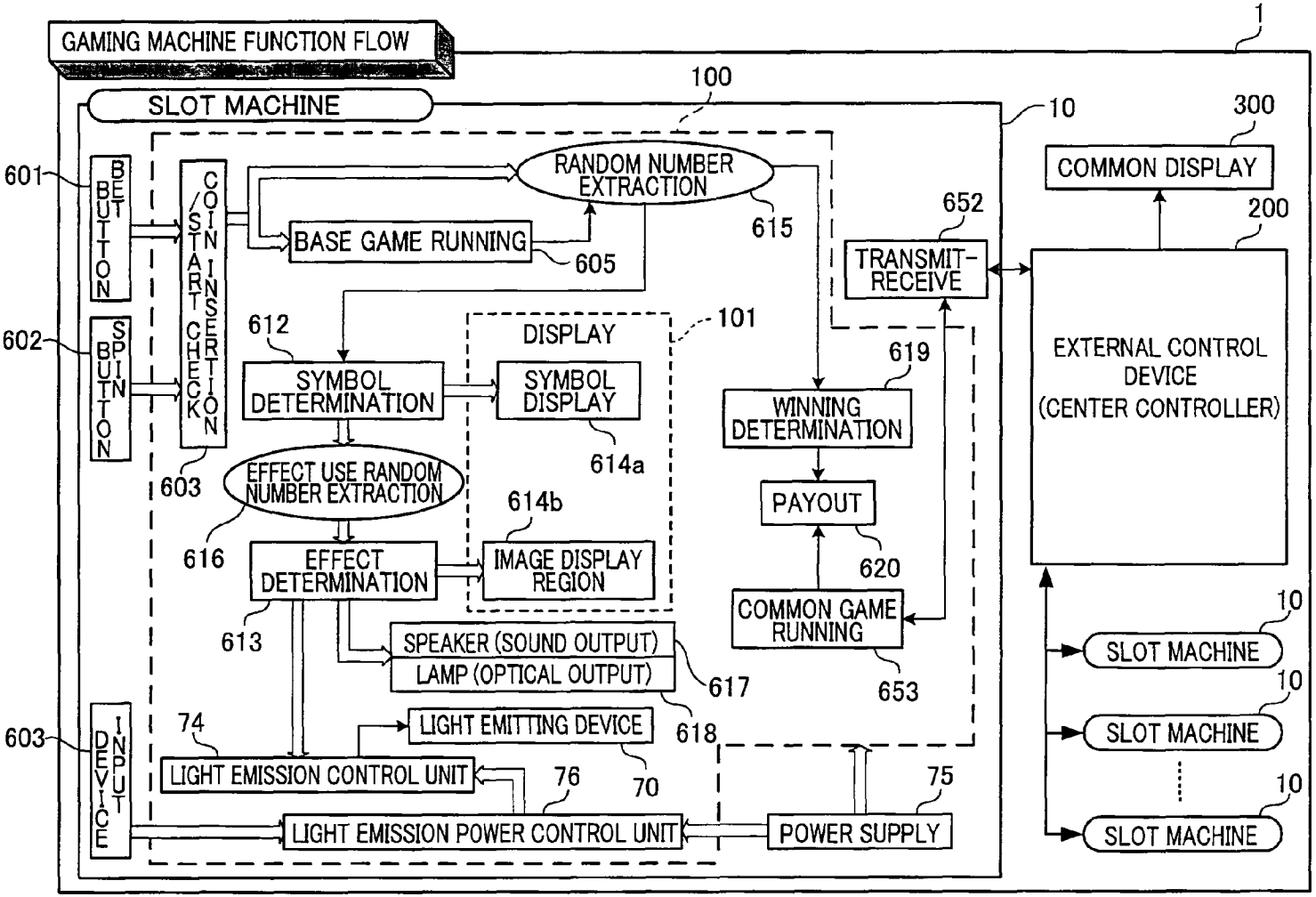
FIG. 2 is a block diagram of the gaming machine.

The gaming machine 1 configured as described above includes slot machines 10, and an external control device (center controller) 200 connected to the slot machines 10 so as to allow data communication therebetween, as illustrated in FIG. 2. The external control device 200 is connected to the slot machines 10 installed in a hall so as to allow data communication therebetween.

The slot machine 10 has a bet button unit 601, a spin button unit 602, an input device 603, the terminal display 101, and the terminal controller 100 which controls these units. Note that the bet button unit 601 and the spin button unit 602 each are a kind of an input device. Further, the slot machine 10 includes a transmit-receive unit 652 and a power supply unit 75. The transmit-receive unit 652 enables data communication between the slot machine 10 and the external control device 200. The power supply unit 75 supplies power to the terminal controller 100 and the light emitting portion 79.

The bet button unit 601 has a function of accepting a player's operation to enter a bet amount. The spin button unit 602 has a function of receiving a start of a game such as the base game through a player's operation, that is, start operation. The terminal display 101 has a function of displaying various symbols and numerical values, still-image information such as a sign, and moving-image information such as an effect image. Further, the terminal display 101 includes a touch panel serving as the input device, and has a function of accepting various instructions each entered by a player's push operation.

The power supply unit 75 supplies power to the terminal controller 100 for running the base game. Further, the power supply unit 75 supplies power to the light emission control unit 74 via the light emission power control unit 76. The light emission control unit 74 causes the light emitting portion 79 to emit light with the power supplied thereto, and controls the light emitting portion 79 to emit light in a lighting mode associated with a game state, as described below. Through the input device 603, a predetermined input can be externally inputted. The input device 603 transmits an input signal to the light emission power control unit 76 in response to the predetermined input.

The terminal controller 100 includes a coin insertion/start-check unit 603, a base game running unit 605, a random number extraction unit 615, a symbol determination unit 612, an effect-use random number extraction unit 616, an effect determination unit 613, a speaker unit 617, a lamp unit 618, a winning determination unit 619, a payout unit 620, a light emitting portion 79, a light emission control unit 74, and a light emission power control unit 76.

The base game running unit 605 has functions of accepting a bet input through the bet button unit 601 relative to a bet amount corresponding to data of a bet amount bettable on the base game, and running a regular game in the base game with an operation on the bet button unit 601. In other words, a bet is accepted based on an input through the bet button unit 601 (input device), and a unit game of the base game is run when the bet is accepted.

Here, a unit game includes a series of operations performed within a period between a start of accepting a bet to a point where a winning may be resulted. For example, a unit game of the regular game contains one each of the following: a bet time where a bet is accepted; a game time where symbols having been stopped are rearranged; and a payout time where a payout process is performed to award a payout.

The symbol determination unit 612 has functions of: determining symbols to be rearranged with a random number extracted by the random number extraction unit 615; rearranging the determined symbols in a symbol display region 614*a* of the terminal display 101; outputting information on rearrangement of the symbols to the winning determination unit 619; and outputting an effect instruction signal to the effect-use random number extraction unit 616, based on a rearrangement of the symbols.

The effect-use random number extraction unit 616 has functions of: when receiving an effect instruction signal from the symbol determination unit 612, extracting an effect-use random number; and outputting the effect-use random number to the effect determination unit 613. The effect determination unit 613 has functions of: determining an effect with an effect-use random number; outputting image information on the determined effect to an image display region 614*b* of the terminal display 101; and outputting audio/light emission information of the determined effect to the speaker unit 617, the lamp unit 618, and the light emission control unit 74. Note that a signal indicating a lighting mode of the light emitting portion 79 inputted to the light emission control unit 74 is referred to as a lighting mode instruction signal.

The light emission control unit 74 has functions of: causing the light emitting portion 79 to emit light with power supplied from the power supply unit 75; and controlling the light emitting portion 79 so that it emits light in a lighting mode based on a lighting mode instruction signal outputted from the effect determination unit 613. Triggered by an input signal from the input device 603, the light emission power control unit 76 performs control so that power supply to the light emission control unit 74 is stopped. This causes the light emission control unit 74 and the light emitting portion 79 to be reset.

The winning determination unit 619 has functions of: determining whether a winning is achieved when information on symbols rearranged and displayed on the terminal display 101 is given; calculating a payout amount based on a winning combination when it is determined that a winning has been achieved; and outputting a payout signal to the payout unit 620, which payout signal is based on the payout amount. The payout unit 620 has a function of awarding the player a game value in the form of a coin, a medal, credit, or the like.

The "game value" is a coin, paper money, or electronic valuable information corresponding to these. Note that the game value in the present invention is not particularly limited. Examples of the game value include game media such as medals, tokens, electronic money, tickets, and the like. A ticket is not particularly limited, and a later-mentioned barcoded ticket may be adopted for example.

Further, the terminal controller 100 has a common game running unit 653. The common game running unit 653 has a function of running a common game with data transmitted from the external control device 200. Further, the common game running unit 653 has a function of determining a win or loss which causes the common game to end, based on game result information from the external control device 200, and when a win is resulted, awarding a winning payout.

Note that the terminal controller 100 is described to include the light emitting portion 79, the light emission control unit 74, and the light emission power control unit 76; however, the structure is not limited to this. For example, the gaming machine 1 may be structured in such a manner that these members are provided as external devices connected to each gaming terminal so as to allow data communication therebetween. Alternatively, these members may be provided to the center controller 200.

(Functional Block of Gaming Machine 1: External Control Device)

The slot machines 10 described above are connected to the external control device 200. The external control device 200 has a function of remotely controlling and remotely monitoring an operating condition of each slot machine 10 or a process of changing set values of various games, for example. Further, the external control device 200 has a function of controlling execution of the common game. The external control device 200 performs common game process determination and the like.

(Operations of Gaming Machine 1)

Figure 3:
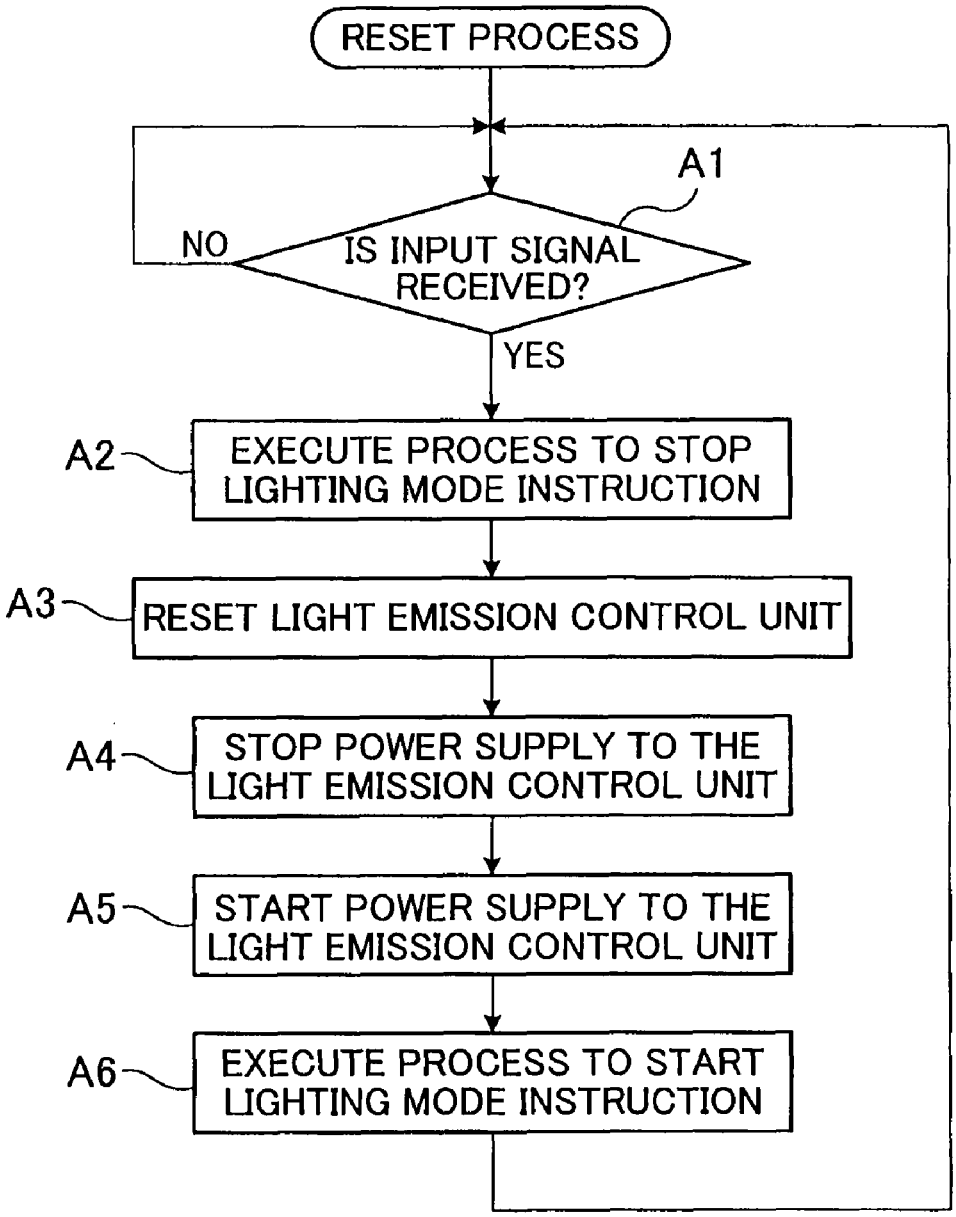
FIG. 3 is a flow chart illustrating an operation of the gaming machine.

With reference to a flowchart of FIG. 3, the following describes operations of the gaming machine 1 having the above described functional blocks. Note that in the present invention, the "gaming terminal" in the flow chart refers to a slot machine 10 which runs a slot game. The "gaming terminal," however, is not limited to this.

(Operations of Slot Machine 10)

The slot machine 10 serving as a gaming terminal carries out a base game process and a reset process. Specifically, the base game process (regular game and the like) is run, and a series of operations below are carried out.

(Coin Insertion/Start-Checking)

First, the slot machine 10 checks if the bet button unit 601 and sequentially the spin button unit 602 are pushed in this order by the player.

(Symbol Determination)

Next, when the player pushes the spin button unit 602, the slot machine 10 extracts a random number for symbol determination. Then, for each video reel displayed on the display unit 614, the slot machine 10 determines symbols to be presented to the player when the symbol columns stop spinning.

(Symbol Display)

Next, the slot machine 10 starts scrolling a symbol column of each video reel, and stops the scrolling so that the symbols determined are presented to the player.

(Winning Determination)

Next, when the symbol column of each video reel stops spinning, the slot machine 10 determines whether a combination of the symbols presented to the player yields a winning.

(Payout)

Next, when a combination of symbols presented to the player yields a winning, the slot machine 10 awards the player a profit according to the combination of the symbols.

For instance, when a combination of symbols which yields a payout of one or more coins are displayed, the slot machine 10 pays out the number of coins according to the combination of symbols to the player.

Next, whether a bonus combination is formed is determined. When a bonus combination is formed, a bonus game process is run. Meanwhile, when no bonus combination is formed, a regular game is run again. During a period of time where a base game including a regular game and a bonus game is in progress, running state information is transmitted to the external control device 621, which running state information indicates a start and an end of a regular game and the bet amount placed on a unit game. This allows the external control device 200 to perform centralized control of each slot machine 10.

(Reset Process)

Further, during the base game process or while waiting for the base game process to begin, the slot machine 10 carries out the following reset process in order to rectify an error in a display mode of the light emitting portion 79. In other words, the slot machine 10 carries out the following reset process of (A1) to (A6) when a predetermined input is performed on the input device 603.

First, the slot machine 10 determines whether the light emission power control unit 76 has received an input signal from the input device 603 (A1). When an input signal has not been received (A1: NO), step A1 is repeated.

Meanwhile, when an input signal has been received (A1: YES), a process to stop a lighting mode instruction is performed (A2). Specifically, the light emission power control unit 76 outputs a lighting mode instruction stop signal to the effect determination unit 613. The effect determination unit 613 having received the lighting mode instruction stop signal stops transmission of lighting mode instruction signals to the light emission control unit 74.

Afterwards, the slot machine 10 resets the light emission control unit 74 (A3). Specifically, the light emission power control unit 76 outputs a reset signal to the light emission control unit 74. The light emission control unit 74 having received the reset signal resets information related to an effect mode kept by the light emission control unit 74.

Then, the slot machine 10 stops power supply to the light emission control unit 74 (A4). In other words, the power supply to the light emitting portion 79 is stopped. Afterwards, the slot machine 10 starts power supply to the light emission control unit 74 (A5). Note that the power supply to the light emission control unit 74 begins after a predetermined period of time elapses after step A4. In other words, the light emission control unit 74 starts the power supply to the light emitting portion 79 to control a lighting mode of the light emitting portion 79 to cause the lighting mode to be at its initial state.

Further, the slot machine 10 carries out a process to start a lighting mode instruction (A6). Specifically, the light emission power control unit 76 outputs a lighting mode instruction start signal to the effect determination unit 613. The effect determination unit 613 having received the lighting mode instruction start signal starts transmission of a lighting mode instruction signal to the light emission control unit 74. Thus, the light emission control unit 74 controls the light emitting portion 79 to cause the light emitting portion 79 to emit light in a lighting mode based on the lighting mode instruction signal. Thereafter, the process returns to A1.

Note that step A3, i.e., the process to reset the light emission control unit 74, may be carried out after the power supply to the light emission control unit 74 has been started, or both before the power supply is stopped and after the power supply has been started.

(Mechanical Structure of Gaming Machine 1)

Next, the following describes a specific example of mechanical and electrical structures of the gaming machine 1 thus structured.

As illustrated in FIGS. 1 and 4, the gaming machine 1 has slot machines 10, the center controller 200, a bonus payout display unit 300, and path units 401. The slot machines 10 each run the base game independently. The center controller 200 is connected in communication with the slot machines 10 and runs the bonus game. The bonus payout display unit 300 displays an amount of bonus payout to be awarded in the bonus game. The path units 401 each have a plurality of common game light emitting portions 403 arranged thereon, and form a single path from a position 402 corresponding to a slot machine 10 to the bonus payout display unit 300.

The bonus payout display unit 300 illustrated in FIG. 4 displays the amount of a bonus payout to be awarded in the bonus game (common game). The example illustrated in FIG. 4 shows that the amount of a progressive jackpot is $1234.56. In this embodiment, the bonus payout display unit 300 is structured to include arrays of LEDs provided as light emitters. The bonus payout display unit 300, however, may be structured as a single liquid crystal display. The light emitters are not limited to LEDs, as long as they emit light.

The path units 401 each have a plurality of common game light emitting portions 403 arranged thereon, and each form a single path from a position 402 corresponding to a slot machine 10 to the bonus payout display unit 300. The path units 401 are respectively associated with the slot machines 10.

Each of the common game light emitting portions 403 is an LED (light-emitting diode), and is capable of emitting light in different colors. The common game light emitting portions 403 each light up when activated. Activation of each of the common game light emitting portions 403 are controlled in such a manner that the common game light emitting portions 403 arranged on a path unit 401 sequentially light up from the position 402 corresponding to the slot machine 10 associated with the path unit 401 towards the bonus payout display unit 300.

The common game light emitting portions 403 are not limited to LEDs as long as they emit light. The presentation of activation state of a common game light emitting portion 403 is not limited to lighting the common game light emitting portion 403. In other words, the activation state may be presented by flashing the common game light emitting portion 403. Further, each of the common game light emitting portions 403 may be capable of emitting light in a single color; however, it is preferable that the common game light emitting portions 403 each be capable of emitting light in more than one color to provide a wide variety of effects.

(Mechanical Structure of Slot Machine 10)

As illustrated in FIG. 6, each slot machine 10 includes a cabinet 11 which is a housing, a top box 12 provided above the cabinet 11, and a main door 13 provided on the front face of the cabinet 11. The main door 13 has a lower image display panel 16. The lower image display panel 16 has a transparent liquid crystal panel for displaying various types of information. The lower image display panel 16 displays display windows 151 to 155 and a matrix for arranging symbols therein. The lower image display panel 16 further displays as necessary various types of information and effect images related to a game.

The present embodiment deals with a case where the lower image display panel 16 electrically displays symbols arranged in five rows/three columns. However, the present invention is not limited to this.

The lower image display panel 16 displays a single activated payline L. Note that the number of paylines L may be two or more. In the case where two or more paylines L are provided, the number of activated paylines L may be determined according to a predetermined condition, such as the number of coins placed as a bet.

Note that the lower image display panel 16 may have a credit amount display unit and a payout amount display unit. The credit amount display unit displays a total amount of coins that the slot machine 10 can pay out to a player (hereinafter also referred to as total credit amount). The payout amount display unit displays the number of coins to be paid out when a combination of symbols stopped along the payline L forms a winning combination.

Further, scatter symbols may be adopted, and the number of coins to be paid out may be determined according to the number of scatter symbols displayed on the matrix. Further, the payline L does not necessarily have to be displayed.

Provided below the lower image display panel 16 are a control panel 20, a coin insertion slot 21, and a bill validator 22. The control panel 20 is provided with buttons 23 to 27. These buttons 23 to 27 allow a player to input instructions related to a game played by the player. Through the coin insertion slot 21, a coin is received in the cabinet 11.

The control panel 20 includes a spin button 23, a change button 24, a cashout button 25, a 1-bet button 26, and a maximum bet button 27. The spin button 23 is for inputting an instruction to start symbol rotation. The change button 24 is used for asking a staff member at the gaming facility for exchange of money. The cash out button 25 is for inputting an instruction to pay out coins corresponding to the total credit amount into the coin tray 18.

The 1-bet button 26 is used for betting one coin out of those corresponding to the total credit amount. The maximum bet button 27 is used for betting, out of those corresponding to the total credit amount, a maximum number of coins (e.g., fifty coins) bettable on one game.

The bill validator 22 validates whether a piece of paper money is legitimate or not and accepts a legitimate one into the cabinet 11. Note that the bill validator 22 is capable of reading a barcode attached to a later-mentioned barcoded ticket 39. When the bill validator 22 reads the barcoded ticket 39, the bill validator 22 outputs to a main CPU 41 a signal representing information having been read from the barcode.

On the lower front face of the main door 13, that is, below the control panel 20, a belly glass 34 is provided. The belly glass 34 has a character related to the slot machine 10 or the like drawn thereon. On the front face of the top box 12, an upper image display panel 33 is provided. The upper image display panel 33 has a liquid crystal panel and displays an effect image, introduction to and rules of the game, and the like.

Further, the top box 12 has a speaker 29 for audio output. Provided below the upper image display panel 33 are a ticket printer 35, a card reader 36, a data displayer 37, and a keypad 38. The ticket printer 35 prints on a ticket a barcode and outputs the ticket as a barcoded ticket 39. A barcode is encoded data containing a credit amount, date, an identification number of the slot machine 10, and the like. A player can play a game in another slot machine 10 with the barcoded ticket 39, or exchange the barcoded ticket 39 with paper money or the like at a change booth or the like of the game arcade.

The card reader 36 reads/writes data from/onto a smart card. The smart card is carried by a player, and stores thereon data for identifying the player, data relating to a history of games played by the player, or the like.

The data displayer 37 includes a fluorescent display and the like, and displays data read by the card reader 36 and data inputted by the player through the keypad 38. The keypad 38 is for entering instructions or data relating to issuance of a ticket and the like.

On a side face of the top box 12, a key switch 71 serving as an input device is provided. Into the key switch 71, a reset key 73 can be inserted. The reset key 73 inserted into the key switch 71 is rotated with respect to the key switch 71 from outside in order to perform a predetermined input, to output an input signal which triggers reset of the power supply to the light emission control unit 74. Note that in the present embodiment, the key switch 71 and the reset key 73 are employed as input devices, and the operation utilizing the key switch 71 and the reset key 73 is employed as a method of performing a predetermined input. The present invention, however, is not limited to these.

Figure 7:
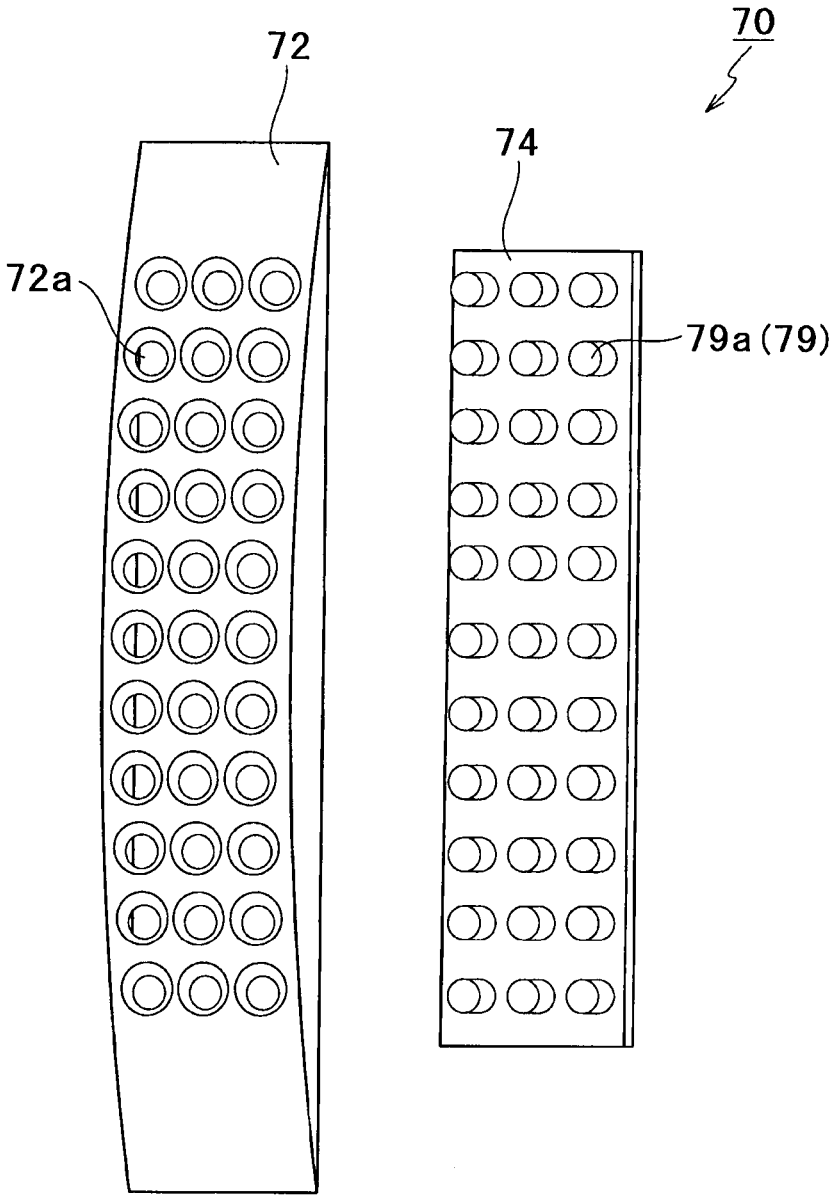
FIG. 7 is an exploded perspective view of a light emitting device.

Provided respectively on right and left sides of the upper image display panel 33 on the front face of the top box 12 are light emitting devices 70 (70R and 70L). FIG. 7 is an exploded perspective view of a light emitting device 70. The light emitting devices 70 each have an exterior member 72, a light emission control unit 74, and a light emitting portion 79, as illustrated in FIG. 7.

The light emission control unit 74 is a plate substrate having a rectangular shape, and has a not-illustrated control circuit. In other words, the control circuit of the light emission control unit 74 controls the light emitting portions 79 so that the light emitting portion 79 emits light in a lighting mode based on a lighting mode instruction signal from the terminal controller (game controller) 100 running the base game. The light emission control unit 74 may randomly select a lighting mode from a not-illustrated ROM storing lighting modes and cause the light emitting portion 79 to emit light in the lighting mode selected, independently of a controller running each game (terminal controller 100, center controller 200 or the like).

The light emitting portion 79 has a plurality of light emitting elements 79*a* (LEDs). The light emitting elements 79*a* are arranged to form a matrix on a front face of the substrate of the light emission control unit 74. The light emitting devices 70L and 70R in the present embodiment each have thirty-three (33) light emitting elements 79*a* arranged in eleven rows and three columns.

Provided to a front and a side of the light emission control unit 74 is the exterior member 72 made of plastic. Plastic is a material having electrostatic propensity. The exterior member 72 is composed of a front face and two side faces. The front face of the exterior member 72 slightly curves in the longitudinal direction from both ends of the longitudinal direction to the center portion to have the center portion of the front face project. The side faces of the exterior member 72 are disposed from both sides of the front face in the transverse direction towards the back. The exterior member 72 is provided to a position surrounding the light emission control unit 74, and shields the light emission control unit 74 at the front and the side faces thereof. The front face of the exterior member 72 is provided with a plurality of through holes 72*a* arranged to form a matrix. The through holes 72*a* are each provided in front of a corresponding light emitting element 79*a* to allow light emitted from the light emitting element 79*a* to travel therethrough when the light emission control unit 74 is shield with the exterior member 72.

(Electrical Structure of Gaming Machine 1)

Figure 9:
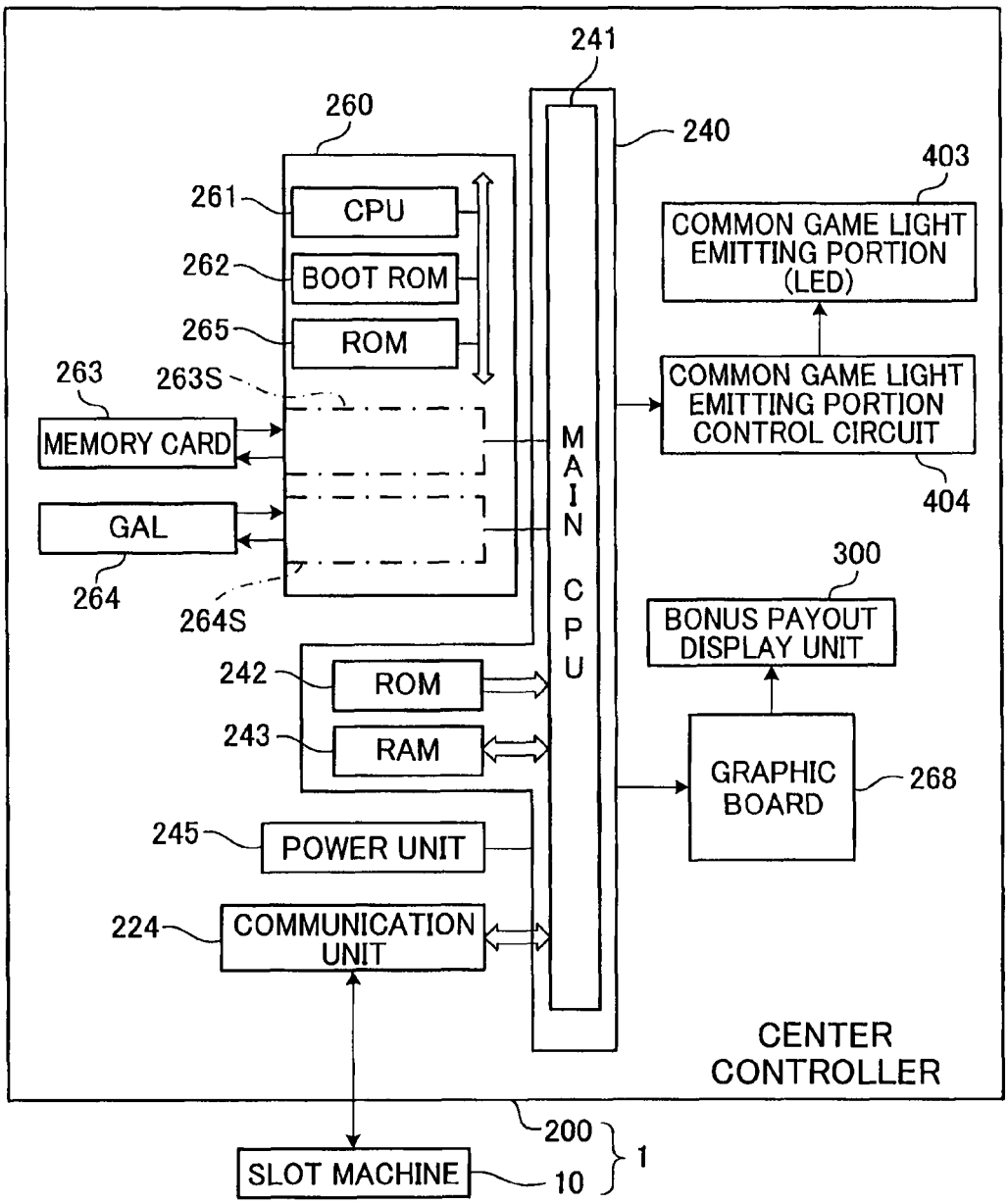
FIG. 9 is a block diagram illustrating an electrical structure of a center controller.

FIGS. 8 and 9 are block diagrams each illustrating an electrical structure of the entire gaming machine 1.

(Electrical Structure of Slot Machine 10)

FIG. 8 is a block diagram illustrating an electrical structure of the slot machine 10. As illustrated in FIG. 8, a control unit including a not-illustrated terminal controller is provided inside the cabinet 11. The control unit includes a motherboard 40, a main body PCB (Printed Circuit Board) 60, a gaming board 50, a door PCB 80, the light emission control unit 74, various switches, sensors, and the like, as illustrated in FIG. 8.

The gaming board 50 is provided with a CPU (Central Processing Unit) 51, a ROM 55, a boot ROM 52, a card slot 53S corresponding to the memory card 53, and an IC socket 54S corresponding to a GAL (Generic Array Logic) 54. The CPU 51, the ROM 55, and the boot ROM 52 are connected to each other via an internal bus.

The memory card 53 stores therein a game program and a game system program. The game program contains a stop symbol determining program. The stop symbol determining program determines symbols (code numbers each corresponding to the symbols) to be stopped in the arrangement areas 150. This stop symbol determining program contains sets of symbol weighting data respectively corresponding to various payout rates (e.g., 80%, 84%, and 80%). Each set of the symbol weighting data indicates, for each of the display windows 151 to 155, a code number of each symbol and at least one random number allotted to the code number. The random number belongs to a predetermined range of numbers, e.g., 0 to 256.

The payout rate is determined based on payout rate setting data outputted from the GAL 54. Based on a set of the symbol weighting data corresponding to the payout rate determined, a symbol to be stopped is determined.

The memory card 53 stores thereon various types of data used in the game program and the game system program. For example, the memory card 53 stores a table listing combinations of symbols to be displayed on the display windows 151 to 155 of FIG. 6 and associated range of random numbers. Note that this data is transferred to a RAM 43 of the motherboard 40, at the time of running the game program.

The card slot 53S is structured so as to allow insertion and ejection of the memory card 53 therein and therefrom. This card slot 53S is connected to the motherboard 40 through an IDE bus. Accordingly, the type and content of a game run by a slot machine 10 can be modified by removing the memory card 53 from the card slot 53S, writing a different game program and a different game system program onto the memory card 53, and inserting the memory card 53 back into the card slot 53S.

A game program includes a program related to the progress of the game and/or a program for causing a transition to a bonus game. The game program includes image data and audio data outputted during the game.

The GAL 54 has input and output ports. When receiving data via an input port, the GAL 54 outputs data corresponding to the input data from an output port. This data from the output port is the payout rate setting data described above.

The IC socket 54S is structured so as to allow insertion and removal of the GAL 54 therein and therefrom. The IC socket 54S is connected to the motherboard 40 via a PCI bus. Thus, the payout rate setting data to be output from the GAL 54 can be modified by: removing the GAL 54 from the IC socket 54S, overwriting the program stored in the GAL 54, and inserting the GAL 54 back into the IC socket 54S.

The CPU 51, the ROM 55 and the boot ROM 52 connected to each other through an internal bus are connected to the motherboard 40 through the PCI bus. The PCI bus communicates signals between the motherboard 40 and the gaming board 50, and supplies power from the motherboard 40 to the gaming board 50. The ROM 55 stores country identification information and an authentication program. The boot ROM 52 stores an auxiliary authentication program and a program (boot code) for enabling the CPU 51 to run the auxiliary authentication program.

The authentication program is a program (falsification check program) for authenticating the game program and the game system program. The authentication program is for confirming and verifying that the game program and the game system program are not falsified. In other words, the authentication program is described in accordance with a procedure for authenticating the game program and the game system program. The auxiliary authentication program is a program for authenticating the authentication program. The auxiliary authentication program is described in accordance with a procedure for verifying that the authentication program to be authenticated is not falsified. In short, the auxiliary authentication program authenticates the authentication program.

The motherboard 40 is provided with the main CPU 41 (terminal controller 100), a ROM (Read Only Memory) 42, the RAM (Random Access Memory) 43, and a communication unit 44.

The main CPU 41 serves as a terminal controller 100 and has a function of controlling the entire slot machine 10. In particular, the main CPU 41 controls the following operations: an operation for outputting a signal instructing moving-display of symbols to the graphic board 68, in response to a push operation performed on the spin button 23 after a credit has been bet; operation for determining symbols to be stopped after the moving display; and an operation for stopping the symbols thus determined in the display windows 151 to 155.

In other words, the main CPU 41 has a function as an arrangement controller which controls operations for selecting symbols to be arranged to form a matrix from among various types of symbols, and stops scrolling the various types of symbols so that the symbols thus determined are rearranged to form a new symbol matrix The ROM 42 stores a program such as a BIOS (Basic Input/Output System) run by the main CPU 41, and permanently-used data. When the BIOS is run by the main CPU 41, each peripheral device is initialized and the game program and the game system program stored in the memory card 53 are read out through the gaming board 50. The RAM 43 stores data or a program used for the main CPU 41 to perform a process.

The communication unit 44 is provided to communicate with a host computer and the like installed in the gaming facility, through the network (communication line). The communication unit 44 is also for communicating with the center controller 200 through a communication line. Further, the main body PCB 60 and the door PCB 80 are respectively connected to the motherboard 40 via USBs (Universal Serial Bus). Further, the motherboard 40 is connected to a power unit 45. The power unit 45 supplies power to the motherboard 40 to boot the main CPU 41 of the motherboard 40. Meanwhile, the power unit 45 supplies power to the gaming board 50 through the PCI bus to boot the CPU 51.

The main body PCB 60 and door PCB 80 are connected to various devices or units which generate signals to be input to the main CPU 41, and various devices or units whose operations are controlled by signals outputted from the main CPU 41. Based on a signal inputted to the main CPU 41, the main CPU 41 runs the game program and the game system program stored in the RAM 43 to perform a calculation process and store the result in the RAM 43, and transmit a control signal to each device and unit to control them.

The main body PCB 60 is connected to a lamp 30, a hopper 66, a coin sensor 67, the graphic board 68, the speaker 29, the bill validator 22, the ticket printer 35, the card reader 36, a key switch 38S, the data displayer 37, the key switch 71, the light emission control units 74, and the light emission power control unit 76.

The lamp 30 is turned on/off on the basis of a control signal from the main CPU 41.

The hopper 66 is mounted in the cabinet 11 and pays out a predetermined number of coins through a coin dispense outlet 19 to the coin tray 18, based on a control signal outputted from the main CPU 41. The coin sensor 67 is provided inside the coin dispense outlet 19, and outputs an input signal to the main CPU 41 when determining that a predetermined number of coins are dispensed through the coin dispense outlet 19.

The graphic board 68 controls image displaying on the upper image display panel 33 and the lower image display panel 16, based on a control signal outputted from the main CPU 41. Further, the graphic board 68 is provided with a VDP (Video Display Processor) for generating image data on the basis of a control signal from the main CPU 41, a video RAM for temporarily storing the image data generated by the VDP, and the like. Note that image data used at the time that the VDP generates the image data is included in the game program read out from the memory card 53 and stored in the RAM 43.

The bill validator 22 reads images on paper money and takes only those recognized as legitimate into the cabinet 11. When taking in a legitimate piece of paper money, the bill validator 22 outputs an input signal to the main CPU 41, the input signal indicating the denomination of the paper money. The main CPU 41 stores into the RAM 43 a credit amount corresponding to the denomination of the paper money indicated by the input signal.

The ticket printer 35 prints a barcode onto a ticket to issue a barcoded ticket 39, based on a control signal outputted from the main CPU 41. The barcode contains encoded data such as a credit amount stored in the RAM 43, date and time, an identification number of the slot machine 10, and the like.

The card reader 36 reads out data from the smart card and transmits the data to the main CPU 41. Further, the card reader 36 writes data onto the smart card based on the control signal outputted from the main CPU 41. The key switch 38S is mounted to the keypad 38, and outputs an input signal to the main CPU 41 in response to an operation on the keypad 38 by the player. The data displayer 37 displays, based on a control signal outputted from the main CPU 41, the data read by the card reader 36 or the data input by the player through the keypad 38.

The key switch 71 performs a predetermined input with the reset key 73 (inserting the reset key 73 into the key switch 71 and rotating the reset key 73) to transmit a signal inputted through the key switch 71 (hereinafter referred to as key switch input signal) to the main body PCB 60.

The light emission control unit 74 includes a not-illustrated control circuit and a CPU, a ROM, a RAM, and the like connected to the control circuit. Further, the light emission control unit 74 is connected to the light emitting portion 79, and controls the light emitting portion 79 so that the light emitting portion 79 emits light in a lighting mode in accordance with an instruction signal from the main body PCB 60. Further, the light emission control unit 74 is connected to the power unit 45 via the light emission power control unit 76. In other words, the light emission control unit 74 causes the light emitting portions 79 to emit light with power supplied from the power unit 45 through the light emission power control unit 76, and controls lighting modes of the light emitting portions 79.

The light emitting portion 79 has light emitting elements 79*a*. Each of the light emitting elements 79*a* is connected to the light emission control unit 74. Turning on and off an individual light emitting element 79*a* are controlled by the light emission control unit 74.

The light emission power control unit 76 has a switching function to control on and off of power supply to the light emission control unit 74. Specifically, the light emission power control unit 76 has a relay, and switches on and off power supply to the light emission control unit 74 based on control signals from the main body PCB 60. Note that the light emission power control unit 76 performs the above switching operation with the power supplied through the main body PCB 60. Further, the switching function related to the power supply to the light emission control unit 74 is realized with a relay in the present embodiment; however, the present invention is not limited to this. A field-effect transistor may be employed, for example.

The door PCB 80 is connected to the control panel 20, a reverter 21S, a coin counter 21C, and a cold cathode tube 81. The control panel 20 is provided with a spin switch 23S associated with the spin button 23, a change switch 24S associated with the change button 24, a cashout switch 25S associated with the cashout button 25, a 1-bet switch 26S associated with the 1-bet button 26, and a maximum bet switch 27S associated with the maximum bet button 27. Each of the switches 23S to 27S outputs an input signal to the main CPU 41, when a player pushes the associated button.

The coin counter 21C is provided within the coin insertion slot 21, and determines whether the coin inserted into the coin insertion slot 21 by the player is valid. Any coin except valid ones is dispensed from the coin dispense outlet 19. In addition, the coin counter 21C outputs an input signal to the main CPU 41 upon detection of a valid coin.

The reverter 21S is operated on the basis of the control signal output from the main CPU 41 and distributes a coin recognized as valid by the coin counter 21C to a not-illustrated cash box or hopper 66 mounted to the slot machine 10. In other words, when the hopper 66 is full of coins, a valid coin is distributed to the cash box by the reverter 21S. On the other hand, when the hopper 66 is not yet full of coins, the valid coin is distributed to the hopper 66. The cold cathode tube 81 functions as a backlight mounted to rear sides of the lower image display panel 16 and the upper image display panel 33. This cold cathode tube 81 turns on in accordance with a control signal from the main CPU 41.

(Electrical Structure of Center Controller 200)

FIG. 9 is a block diagram illustrating an electrical structure of the center controller 200. The center controller 200 is provided therein with a control unit. As illustrated in FIG. 9, the control unit includes a motherboard 240, a gaming board 260, an actuator, and the like.

The gaming board 260 has the same structure as that of the gaming board 50. The motherboard 240 has the same structure as that of the motherboard 40. A communication unit 244 communicates with the terminal controller 100 through a communication line.

The graphic board 268 has the same structure as that of the graphic board 68, except that the graphic board 268 controls displaying of the bonus payout display unit 300 (including light emission control of the light emitting portions 320) based on a control signal from the main CPU 241.

A common game light emitting portion control circuit 404 controls activation of the LEDs provided as the common game light emitting portions 403. Specifically, the common game light emitting portion control circuit 404 causes active and inactive states of each common game light emitting portion 403 based on a control signal outputted from the main CPU 241.

(Running Base Game)

The following describes an example of a base game run in the gaming machine 1. Note that the following example deals with a case where the terminal display 101 (lower image display panel 16) adopts a video reel to rearrange symbols.

As illustrated in FIG. 6, a matrix (display windows 151 to 155) is provided to a center portion of the terminal display 101. Symbols are scroll-displayed in the matrix. The display windows 151 to 155 are divided into an upper tier, a middle tier, and a lower tier. Symbols are stopped (arranged) in the tiers. The matrix is a symbol matrix of five columns and three rows. The matrix, however, is not limited to the one with the five columns/three rows.

When the slot machine 10 starts running a base game, symbols are displayed in motion on the terminal display 101. The motion of the symbols is then stopped, thus symbols are rearranged in the arrangement areas 150. A winning is possibly achieved in accordance with a relation among the symbols rearranged, and a payout according to the winning is awarded.

Note that part of a bet placed by the player is accumulated to form a jackpot each time a base game is started. The value of the jackpot thus accumulated is displayed on the bonus payout display unit 300, as illustrated in FIG. 4.

(Running Bonus Game)

The following describes an example of a bonus game run in the gaming machine 1.

A bonus game is started when the accumulated value of the jackpot exceeds a certain amount. In the bonus game, symbols are rearranged to form a matrix at each slot machine 10. When the symbols rearranged yield a predetermined winning, a random number of common game light emitting portions 403 are activated in the path unit 401 associated with the slot machine 10 where the winning is yield. This operation is repeated until the common game light emitting portions 403 in any one of the path units 401 are activated up to the bonus payout display unit 300.

When the common game light emitting portions 403 in a path unit 401 are activated up to the bonus payout display unit 300, the jackpot is awarded as a bonus payout at the slot machine 10 associated with the path unit 401.

(Symbol, Combination, and the Like)

The matrix on the terminal display 101 includes symbol columns each composed of twenty-two symbols, as illustrated in FIG. 10. Each of the symbols composing a symbol column is given one of code numbers 0 to 21. Each symbol column has a combination of "Angelfish," "Clownfish," "7," "Tuna," "Coelacanth," and "Bonus" symbols.

The display windows 151 to 155 each display (arrange) consecutive three symbols among the symbols forming a symbol column. The symbols arranged in the upper, middle, and lower tiers of each of the display windows 151 to 155 form a symbol matrix of five columns and three rows. The symbol column including the symbols forming the symbol matrix start spinning when the bet button 26 and a start button are sequentially pushed in this order to start a game. This spinning of the symbol column stops after a predetermined period of time has elapsed since the spinning has started (rearrangement).

Further, for each symbol, a predetermined scatter symbol is determined in advance. A predetermined number or more scatter symbols displayed in the matrix put a player in an advantageous state. Examples of the advantageous state include: a state where the number of coins corresponding to the scatter symbol(s) are paid out; a state where the number of coins paid out is added to a credit; and a state where a bonus game is started.

Here, a bonus game offers a more advantageous gaming state than a base game. In this embodiment, the bonus game is a jackpot game. No particular limitation is imposed on the bonus game, as long as it offers an advantageous gaming state to the player. In other words, the bonus game may offer a state where more game media are obtainable than in the base game, a state where a game medium is obtainable with a higher probability than in the base game, a state where fewer game media are consumed than in the base game, for example. Specifically, a free game, a second game, a feature game, and the like may be mentioned as examples of the bonus game.

(Path Unit Table)

FIG. 11 illustrates a path unit table. The path unit table is stored in the ROM 242, and shows the number of common game light emitting portions 403 arranged in each path unit 401. For example, the path unit table indicates that the path units 401*a*, 401*b*, 401*c*, and 401*j* are respectively provided with 100, 120, 120, and 100 common game light emitting portions 403.

(Path Unit Activation Table)

FIG. 12 illustrates a path unit activation table. The path unit activation table is stored in the RAM 243. The path unit activation table shows, for each path unit 401, the number of activated common game light emitting portions 403, the number of common game light emitting portions 403 yet to be activated, the number of winnings achieved, and the remaining number of potential winnings. For instance, in the path unit 401*a*, ten common game light emitting portions 403 are activated, ninety common game light emitting portions are yet to be activated, one winning has been achieved, and there are four potential winnings.

In the path unit activation table illustrated in FIG. 12, the following random numbers are determined when a winning is achieved in the path units 401, respectively. Specifically, the random numbers determined for the path units 401*a*, 401*b*, 401*c*, and 401*j* are respectively 1 to 87, 1 to 106, 1 to 20, and 1 to 67.

(Light Emitting Portion Control Table)

FIG. 13 illustrates a light emitting portion control table. The light emitting portion control table is stored in the ROM which belongs to the light emission control unit 74. The light emitting portion control table indicates a state of a light emitting element 79*a* for each identification information. In the light emitting portion control table, a state of each light emitting element is indicated by a binary number with sixty-six (66) digits. In other words, the light emitting portion control table indicates ON ("1") or OFF ("0") for each of the sixty-six light emitting elements 79*a* in each of the light emitting devices 70L and 70R.

For instance, the lighting mode indicated by identification information 001 is "00000000000 . . . ." This indicates that all the light emitting elements 79*a* are turned off. Further, the lighting mode indicated by identification information 002 is "11111111111." This indicates that all the light emitting elements 79*a* are turned on.

(Lighting Mode Instruction Table)

FIG. 14 illustrates a lighting mode instruction table. The lighting mode instruction table is stored in the RAM 43. The lighting mode instruction table illustrates a lighting mode for each gaming state. In the lighting mode instruction table, a lighting mode is indicated by identification information shown in the light emitting portion control table, and the duration of the lighting mode in the light emitting element indicated by the identification information in seconds (milliseconds).

For example, when the gaming state indicated is "idle," the associated lighting mode is indicated by "003, 1000," and "004, 1000." This shows that the lighting mode of the light emitting elements 79*a* indicated in the light emitting portion control table by identification information 003 continues for 1,000 milliseconds, and the lighting mode of the light emitting elements 79*a* indicated in the light emitting portion control table by identification information 004 continues for 1,000 milliseconds thereafter. This information is transmitted as a lighting mode instruction signal to the light emission control unit 74 to cause the light emission control unit 74 to access the light emitting portion control table to control a lighting mode of a light emitting element 79*a*.

Note that the controlling method of the light emitting portions 79 is not limited to the one with the light emitting portion control table and the lighting mode instruction table.

(Operation of Gaming Machine 1: Boot Process)

Figure 15:
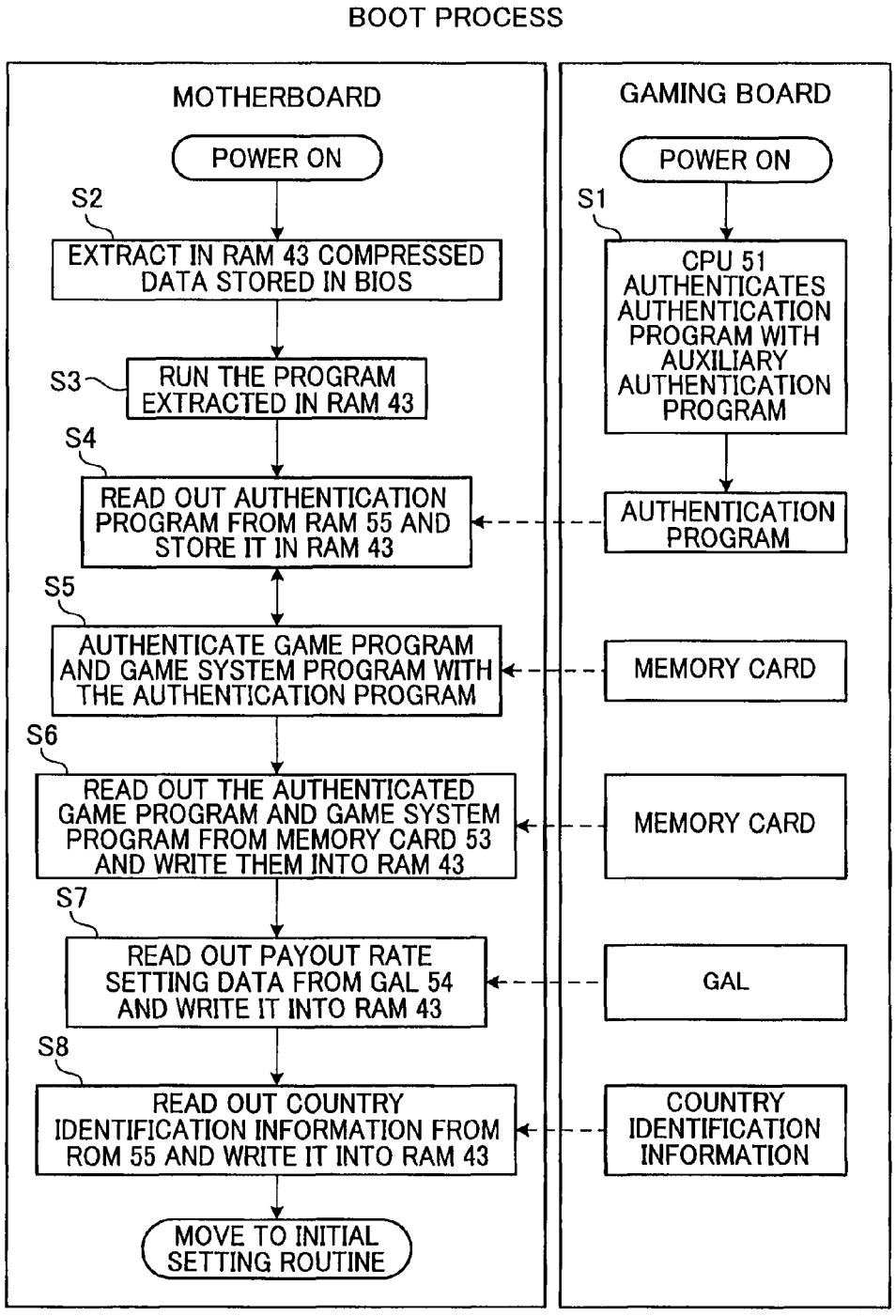
FIG. 15 is a flowchart illustrating a boot process executed by the gaming terminal and the center controller.

The following describes a boot process routine which takes place in the gaming machine 1. Upon powering on the gaming machine 1, a boot process routine illustrated in FIG. 15 is run on the motherboard 240 and the gaming board 260 of the center controller 200, and the motherboard 40 and the gaming board 50 of the terminal controller 100. Note that the boot process routine is carried out with the memory card 53 and a memory card 263 inserted into the card slot 53S and a card slot 263S of the gaming boards 50 and 260, respectively. Likewise, the boot process routine is carried out with the GAL 54 and a GAL 263 inserted into the IC socket 54S and an IC socket 264S, respectively.

First, turning on the power switch to the power unit 45 and a power unit 245 (powering on) boots the motherboards 40 and 240, and the gaming boards 50 and 260. Booting the motherboards 40 and 240 and the gaming boards 50 and 260 causes individual processes to start running in parallel. In other words, in the gaming boards 50 and 260, the CPU 51 and a CPU 261 read out auxiliary authentication programs stored in the boot ROM 52 and a boot ROM 262, respectively. Then, the CPUs 51 and 261 perform auxiliary authentication programs in accordance with the read auxiliary authentication programs to confirm and authenticate that no falsification has been made to the authentication programs, before reading them to the motherboards 40 and 240, respectively (S1). Meanwhile, in the motherboards 40 and 240, the main CPUs 41 and 241 respectively run the BIOSes stored in the ROMs 42 and 242, respectively, and extract, in the RAMs 43 and 243, compressed data built in the BIOS (S2). Then, the main CPUs 41 and 241 run the BIOSes extracted in the RAMs 43 and 243, respectively, to diagnose and initialize various peripheral devices (S3).

The main CPUs 41 and 241, which are respectively connected to the ROMs 55 and 265 of the gaming boards 50 and 260 via PCI buses, read out the authentication programs stored in the ROMs 55 and 265 and stores the read authentication program into the RAM 43 and 243, respectively (S4). During this step, the main CPUs 41 and 241 each yield a checksum with an ADDSUM method (standard check function) which is adopted in a standard BIOS, and store the authentication programs in the RAMs 43 and 241, respectively, while carrying out a process to confirm that the authentication programs are stored in the RAMs 43 and 241 without an error.

Next, the main CPU 41 and 241 each confirm what is connected to the ID bus. The main CPUs 41 and 241 then respectively access, via the IDE bus, the memory cards 53 and 263 respectively inserted into the card slots 53S and 263S to read out the game programs and the game system programs therefrom. In this case, the main CPUs 41 and 241 each read out four bytes of data constituting the game program and the game system program at one time. Next, the main CPUs 41 and 241 carry out an authentication to confirm and prove that the game programs and the game system programs read out are not falsified, in accordance with the authentication program stored in the RAMs 43 and 243, respectively (S5).

When the authentication process properly ends, the main CPUs 41 and 241 write and store the authenticated game program and game system programs into the RAMs 43 and 243, respectively (S6).

Next, the main CPUs 41 and 241 access, via the PCI buses, the GALs 54 and 264 respectively inserted into the IC sockets 54S and 264S, to read payout rate setting data from the GALs 54 and 264 to write and store the payout rate setting data in the RAMs 43 and 243 (S7).

Next, the main CPUs 41 and 241 reads out, via the PCI buses, country identification information stored in the ROMs 55 and 265 of the gaming boards 50 and 260, respectively. The main CPUs 41 and 241 also carry out the process of storing the country information read out into the RAMs 43 and 243, respectively (S8).

Figure 16:
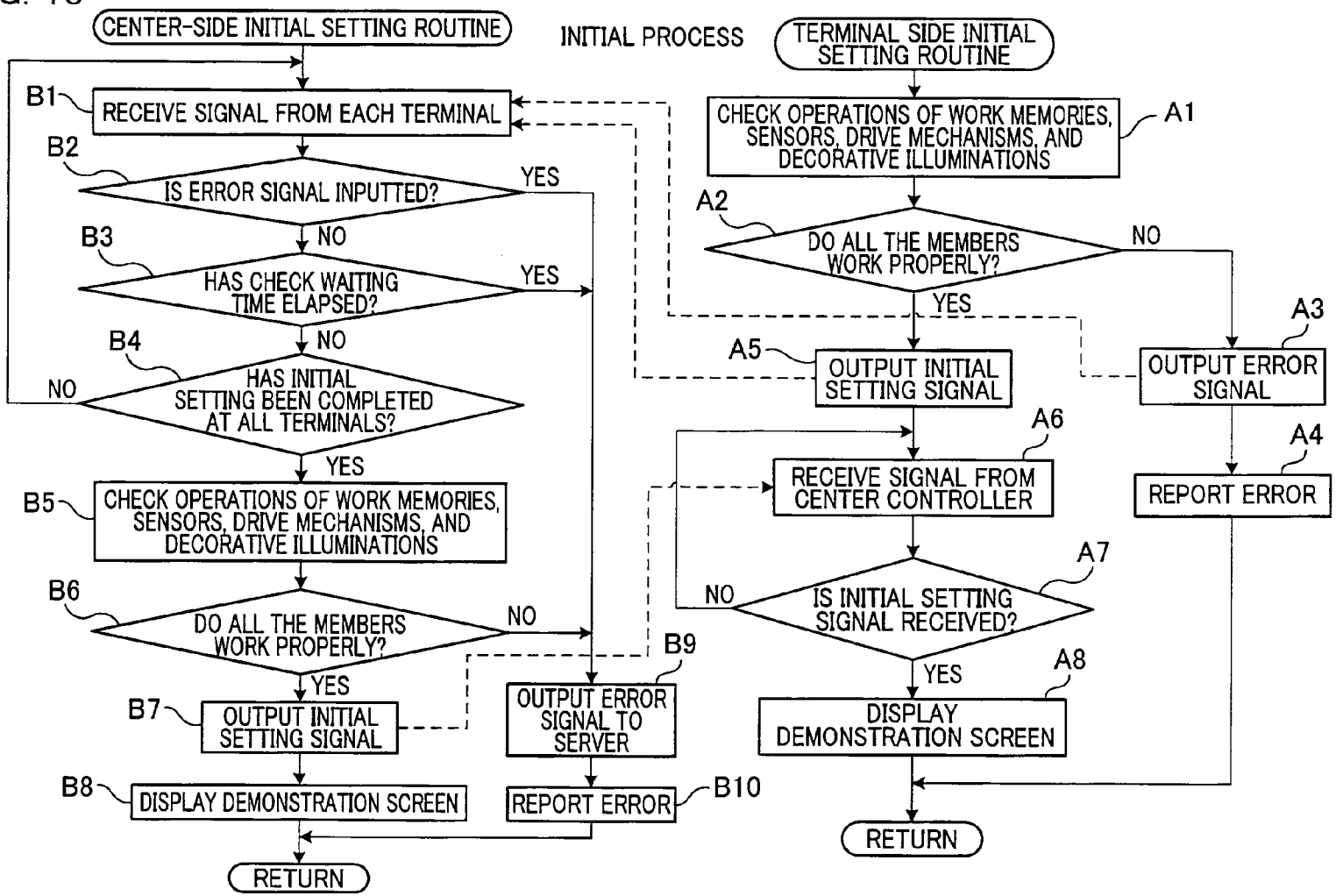
FIG. 16 is a flowchart illustrating an initial process executed by the gaming terminal and the center controller.

After this, the main CPUs 41 and 241 each perform an initial process illustrated in FIG. 16.

(Operations of Gaming Machine 1: Initial Process)

The following describes an initial process which takes place in the gaming machine 1. After the boot process illustrated in FIG. 15 is completed, the center controller 200 reads out from the RAM 243 a center-side initial setting routine illustrated in FIG. 16 and executes the routine. After the boot process illustrated in FIG. 15, the slot machine 10 reads out from the RAM 43 a terminal-side initial setting routine illustrated in FIG. 16 and executes the routine. The center side and terminal side initial setting routines are executed in parallel.

First, the main CPU 41 of each slot machine 10 checks operations of work memories such as the RAM 43, various sensors, various driving mechanisms, and various decorative illuminations (A1). Then, the main CPU 41 determines whether all the check results are normal (A2). When it is determined that not all the check results are normal (A2, NO), the main CPU 41 outputs an error signal to the center controller 200 (A3), and reports the error by turning on the lamp 30 or the like (A4) before ending this routine.

Meanwhile, when it is determined in step A2 that all the check results are normal (A2, YES), the main CPU 41 outputs an initial setting signal to the center controller 200 (A5). Then, an initial setting signal from the center controller 200 is waited (A6, A7: NO).

The main CPU 241 of the center controller 200 receives a signal from each terminal (B1). The main CPU 241 then determines whether each signal received is an error signal (B2). When the main CPU 41 determines that the signal is an error signal (B2: YES), it outputs an error signal to a server of a not-illustrated host computer or the like (B9), and reports the error (B10) before ending the routine.

On the other hand, when the main CPU 241 determines that the signal is not an error signal (B2: NO), the main CPU 241 determines whether a predetermined period of time (check time) has elapsed since the power has been turned on (B3). When it is determined that the check time has elapsed (B3: YES), step B9 is executed. Meanwhile, when it is determined that the check time has not yet elapsed (B3: NO), it is determined whether initial setting signals from all the slot machines 10 have been received (B4). When it is determined that initial setting signals have not been received from all the slot machines 10 (B4: NO), the process returns to B1. On the other hand, when it is determined that initial setting signals are received from all the slot machines 10 (B4: YES), the main CPU 241 checks operations of work memories such as the RAM 243, various sensors, various driving mechanisms, and various decorative illuminations (B5). Then, the main CPU 241 determines whether all the check results are normal (B6). When it is determined that the check results contain an error (B6: NO), step B9 is executed.

On the other hand, when it is determined in B6 that all the check results are normal (B6: YES), the main CPU 241 outputs an initial setting signal to each of the slot machines 10 (B7), and causes the common display 102 to display a demo screen before ending this routine.

The main CPU 41 of each of the slot machines 10 then determines in A7 that it has received an initial setting signal from the center controller 200 (A7: YES), and causes the terminal display 101 to display a demo screen (A7) before ending this routine.

(Operations of Slot Machine 10: Gaming Terminal Process Routine) After the terminal side initial setting routine of FIG. 16, the main CPU 41 of the slot machine 10 performs a gaming terminal process routine of FIG. 17. The main CPU 41 executes the game terminal process routine to run a game.

Figure 17:
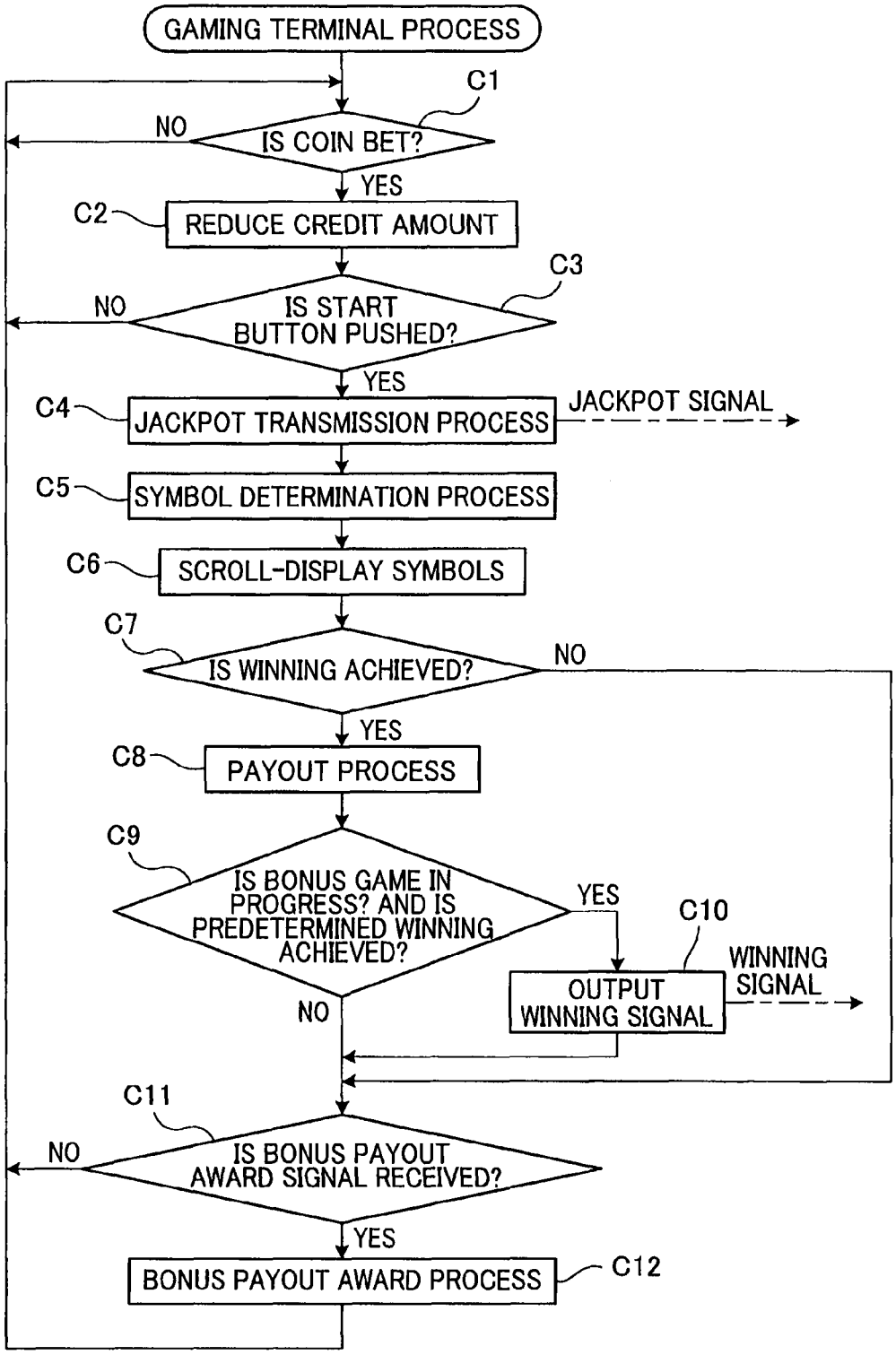
FIG. 17 is a flowchart illustrating a gaming terminal process routine executed by the gaming terminal.

As illustrated in FIG. 17, in the terminal process routine, it is determined whether a coin is bet (C1). In this step, it is determined whether an input signal from the 1-bet switch 26S entered by the 1-bet button 26 being pushed is received. Meanwhile, it is determined whether a signal from the maximum bet switch 27S entered by the maximum bet button 27 being pushed is received. When no coin is bet (C1: NO), C1 is repeated until a coin is bet.

Meanwhile, when a coin is bet (C1: YES), the credit amount stored in the RAM 43 is reduced according to the number of coins bet (C2). When the number of coins bet surpasses the number of coins equivalent to the credit amount stored in the RAM 43, the process moves to later-described C3 without the reduction of the credit amount. When the number of coins bet exceeds the maximum number of coins bettable on one game (50 coins in this embodiment), the process moves to later-described C3 without the reduction of the credit amount.

Then, it is determined whether a spin button 23 is pushed (C3). When the spin button 23 is not pushed (C3: NO), the process returns to C1. Note that when the spin button 23 is not pushed (for example, the spin button 23 is not pushed but an instruction to end the game is inputted), the reduction of the credit value in C2 is canceled.

Meanwhile, when the spin button 23 is pushed (C3: YES), a jackpot transmission process is executed (C4). In other words, a jackpot signal indicating a part of the game value bet is transmitted to the center controller 200.

Next executed is a symbol determining process (C5). That is, the stop symbol determining program stored in the RAM 43 is run to determine symbols to be arranged in the matrix. Through this, a symbol combination to be formed along the payline L is determined.

Then, the scrolling process is executed to scroll-display symbols on the terminal display 101 (C6). This scrolling process is for scrolling symbols in a direction indicated by an arrow and stops the symbols determined in steps C5 in the matrix (rearrangement).

Next, it is determined whether a combination of symbols rearranged in the matrix yields a winning (C7). When it is determined that a winning is yield (C7: YES), a payout process is executed (C8). More specifically, when a winning is yield, the number of coins according to the combination is calculated. Meanwhile, in C7, when it is determined that no winning is yield (C7: NO), step C11 is executed.

After the execution of the payout process in C8, the main CPU 41 determines whether a bonus game is in progress and whether a predetermined winning is yield (C9). If a bonus game start signal is received from the center controller 200, the main CPU 41 determines that the bonus game is in progress. When it is determined that the bonus game is in progress and a predetermined winning is yield (C9: YES), a winning signal is outputted to the center controller 200 (C10), and step C11 is executed. Meanwhile, when it is determined that the bonus game is not in progress, or the predetermined winning is not yield (C9: NO), step C11 is executed.

Next, the main CPU 41 determines whether a bonus award signal is received from the center controller 200 (C11). When the main CPU 41 determines that a bonus award signal is received (C11; YES), a payout is awarded according to the bonus award signal (C12), and the process is brought back to C1. Meanwhile, when it is determined in C11 that no bonus award signal is received (C11: NO), the process is brought back to C1.

Note that although it is not illustrated, the main CPU 41 outputs a lighting mode instruction signal based on game information to the light emission control unit 74 in the gaming terminal process routine. For example, when a payout is to be awarded in C8, the main CPU 41 transmits information on a lighting mode to the light emission control unit 74, the lighting mode associated with an idle gaming state in the lighting mode instruction table of FIG. 14. The light emission control unit 74 controls the light emitting portions 79 based on the lighting mode instruction signal.

Figure 18:
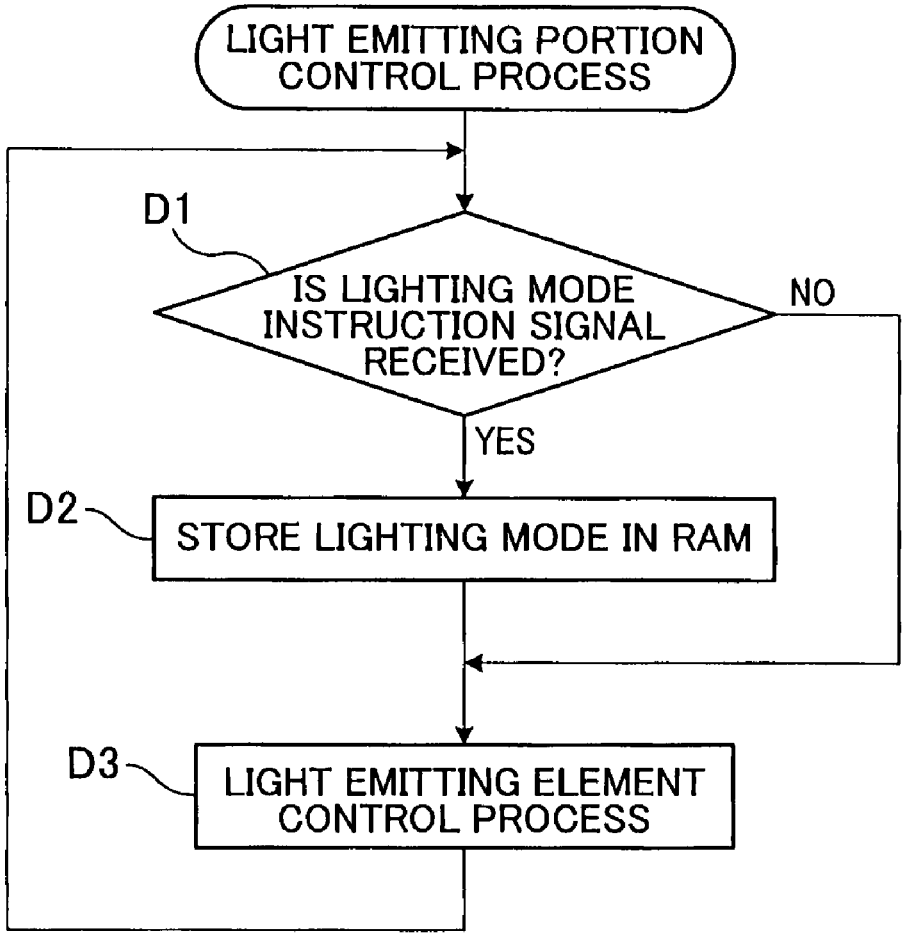
FIG. 18 is a flowchart illustrating a light emitting portion control process routine executed by a light emission control unit.

(Operations of Slot Machine 10: Light Emitting Portion Control Process Routine) A CPU of the light emission control unit 74 executes a light emitting portion control process routine illustrated in FIG. 18 independently of the main CPU 41 of the slot machine 10 to perform control of the light emitting portions 79.

First, the CPU of the light emission control unit 74 determines whether a lighting mode instruction signal outputted in a gaming terminal process routine run by the main CPU 41 of the slot machine 10 is received (D1). When a lighting mode instruction signal is received (D1: YES), the CPU of the light emission control unit 74 stores in the RAM of the light emission control unit 74 each lighting mode included in the lighting mode instruction signal (D2). In this step, the CPU of the light emission control unit 74 deletes each lighting mode included in the RAM and stores a new lighting mode.

Meanwhile, when no lighting mode instruction signal is received (D1: NO), or after execution of step D2, the CPU of the light emission control unit 74 executes a light emitting element control process (D3). Specifically, the CPU of the light emission control unit 74 controls on and off of each light emitting element in a lighting mode stored in the RAM. In other words, the CPU of the light emission control unit 74 repeats the current lighting mode until it receives a lighting mode instruction signal and thus a new lighting mode is stored in the light emission control unit 74. The process is brought back to D1 after execution of step D3.

Note that in step D3, when more than one lighting modes are included in the lighting mode instruction signal received in D1, one of the lighting modes is executed. In other words, the CPU of the light emission control unit 74 keeps in the RAM information on a previously executed lighting mode, and the CPU executes the following lighting mode. Information on the executed lighting mode is reset in step D2.

Thus, independently of the process(es) executed by the main CPU 41 of each of the slot machines 10, the CPU of the light emission control unit 74 controls on and off of each lighting element 79*a* of the light emitting portion 79 in the lighting mode associated with a lighting mode instruction signal.

Although it is not illustrated, the main CPU 41, in the light emitting portion control process routine, controls the light emitting portion 79 so that the light emitting portion 79 emits light in a predetermined lighting mode stored in the ROM. In other words, when no base game has been run for a while, or when power supply to the motherboard 40 and the like running the base game alone is halted, the light emitting portion 79 is controlled so that the light emitting portion 79 emits light in the predetermined lighting mode.

Accordingly, the light emitting portion 79 can be controlled by the light emission control unit 74 such that the light emitting portion 79 emits light in the predetermined lighting mode, even when no power is supplied to the motherboard 40. This allows the power supply to the motherboard 40 and the like to be shut down, which results in power saving on the gaming machine 1. Further, controlling the light emitting portion 79 to cause it to emit light in the predetermined lighting mode facilitates retention of an entertainment characteristic of a game arcade or the like in which the gaming machine 1 is installed.

(Operations of Slot Machine 10: Reset Process Routine)

Figure 19:
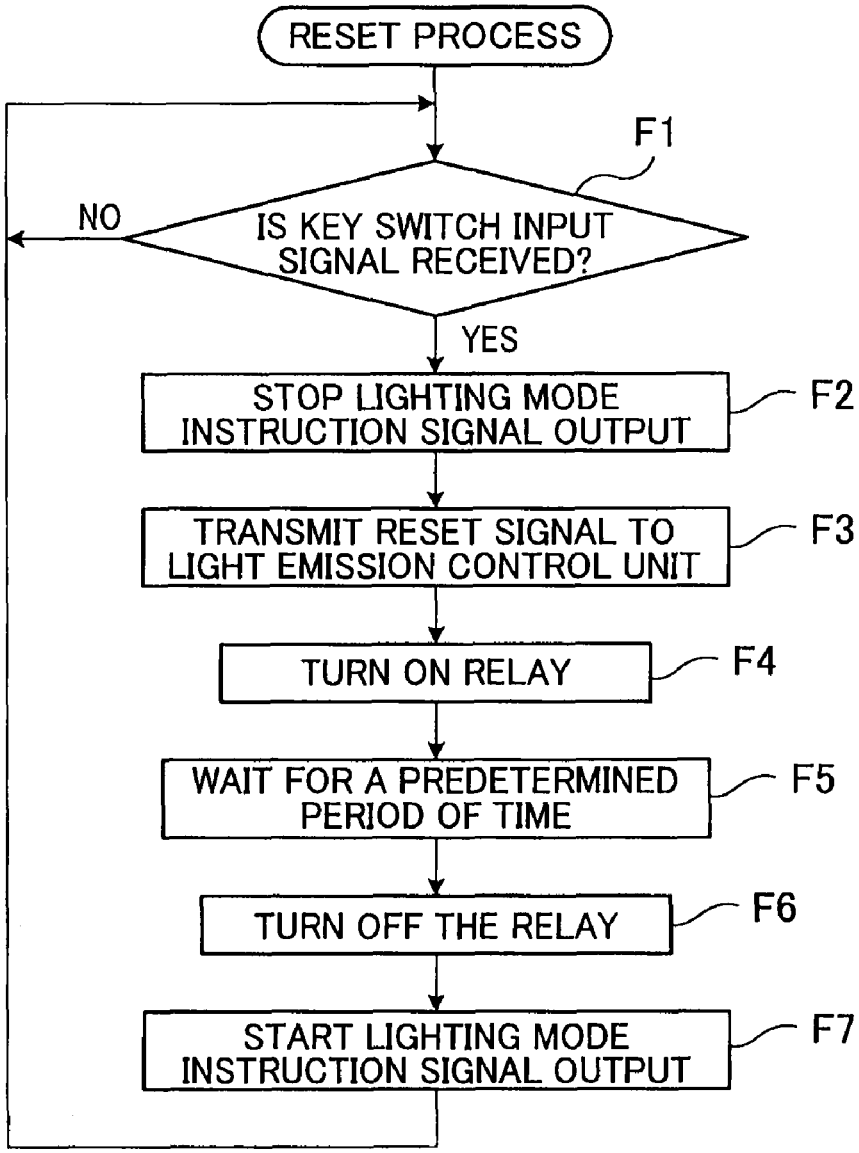
FIG. 19 is a flowchart illustrating a reset process routine executed by the gaming terminal.

The main CPU 41 of the slot machine 10 executes a reset routine illustrated in FIG. 19 to reset the light emission control unit 74 which controls the light emitting portion 79 as described above.

First, the main CPU 41 of the slot machine 10 determines whether a key switch input signal from the key switch 71 is received (F1). In other words, the main CPU 41 determines whether a predetermined input, that is, insertion and rotation of the reset key 73 is performed on the key switch 71. When no key switch input signal is received (F1: NO), step F1 is repeated.

Meanwhile, when a key switch input signal is received (F1: YES), the main CPU 41 executes a process to stop an output of lighting mode instruction signal (F2). Specifically, the main CPU 41, in the gaming terminal process routine, stops a process for outputting a lighting mode instruction signal to the light emission control unit 74

Afterwards, the main CPU 41 transmits a reset signal to the light emission control unit 74 (F3). This reset signal causes a flip-flop and the like of a circuit substrate which belongs to the light emission control unit 74 to be reset to an initial state.

Then, the main CPU 41 turns off the relay of the light emission power control unit 76 to halt the power supply to the light emission control unit 74 (F4). That is, the power supply to the light emitting portion 79 is halted. After a predetermined period of time has elapsed thereafter (F5), the main CPU 41 turns back on the relay of the light emission power control unit 76 to resume the power supply to the light emission control unit 74 (F6).

Further, the main CPU 41 starts outputting a lighting mode instruction signal (F7). Specifically, the main CPU 41, in the gaming terminal process routine, starts a process to output a lighting mode instruction signal to the light emission control unit 74. Further, in step F7, the main CPU 41 causes the lower image display panel 16 to display information indicating that the light emitting device 70 has been reset, as illustrated in FIG. 1. The process returns to F1 thereafter.

Note that a process to transmit a reset signal to the light emission control unit 74 may be performed after the power supply to the light emission control unit 74 has begun. Further, the process may be performed both before the power supply is halted and after the power supply has begun.

Accordingly, the power supply to the light emission control unit 74 is resettable while a base game is in progress. Further, the light emission control unit 74 is resettable without halting the game even when an error occurs in the light emission control unit 74 which possibly causes an unusual display mode of the light emitting portion 79.

Thus, it is possible to show a player who plays a game that the gaming machine 1 is capable of resetting the light emission control unit 74 alone, while retaining data and the like in the RAM 43 during the base game. This prevents decrease in credibility of the gaming machine 1 and the administrator thereof with the player. As a result, it is possible to prevent deterioration in the entertainment characteristic caused by an error in a light emitting device.

In the present embodiment, for example, each slot machine 10 transmits a part of a bet amount placed as a bet to the center controller 200. A jackpot value thus stored is awarded as a payout of the bonus game at a slot machine 10 where a win is resulted in the bonus game, the win determined based on a result of the bonus game. Accordingly, a result of the bonus game which offers a chance of winning a large payout is determined based on a result of the base game. Thus, occurrence of an error in the light emitting portion 79 whose lighting mode is determined on the basis of the base game can possibly give a player an uneasy feeling. Meanwhile, the slot machine 10 of the present embodiment is capable of rebooting only the light emission control unit 74 which controls the light emitting portion 79, without rebooting the motherboard 40 running the base game. Thus, the slot machine 10 of the present embodiment does not give a player such an uneasy feeling. Further, the motherboard 40 and the like running the base game are not rebooted. Therefore, a player does not need to check whether the slot machine 10 still retains a parameter of the base game which influences the bonus game.

(Operations of Center Controller 200: Center Process Routine)

Figure 20:
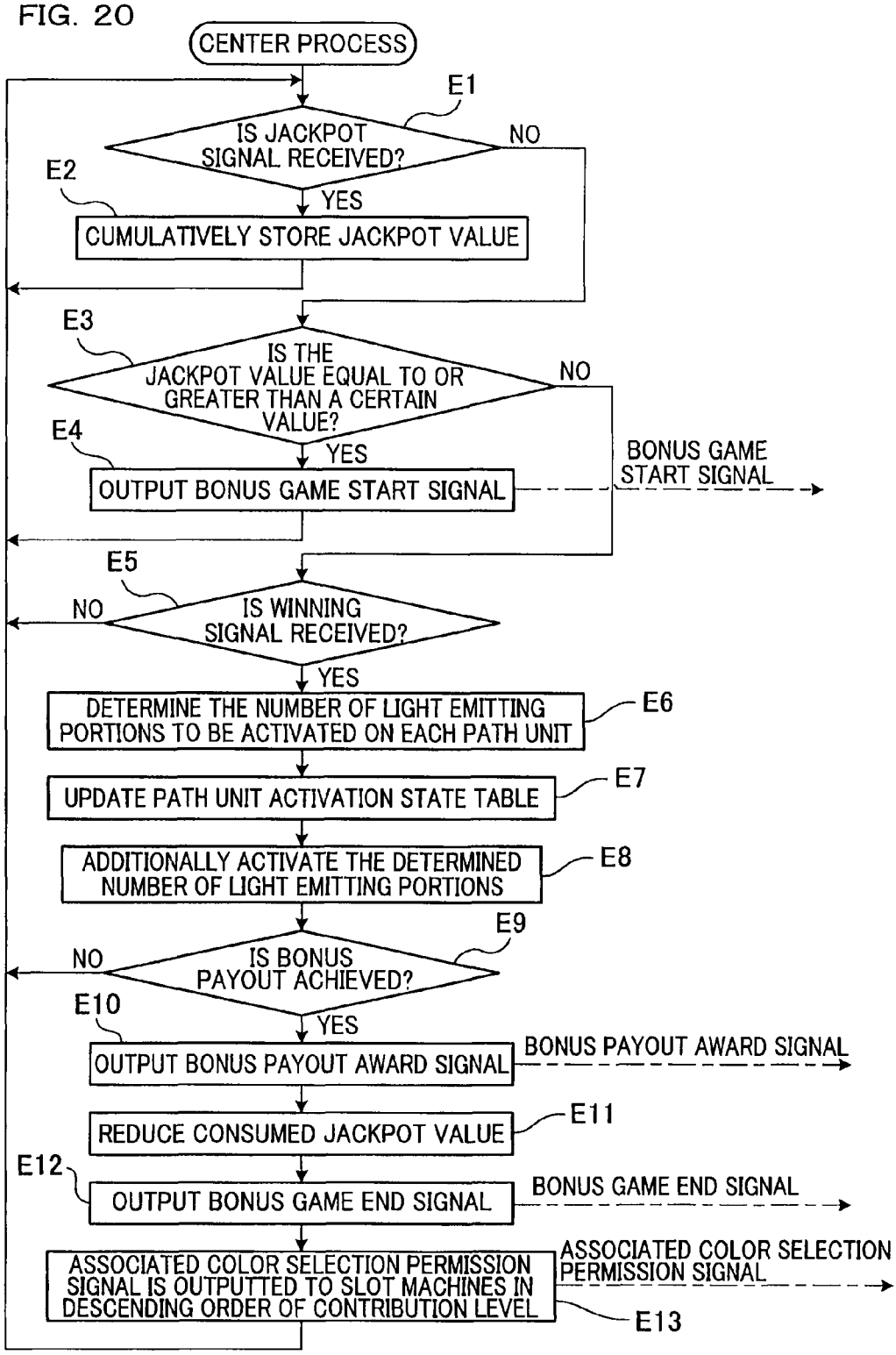
FIG. 20 is a flowchart illustrating a center process routine executed by the center controller.

After executing the center-side initial setting routine illustrated in FIG. 16, the main CPU 241 of the center controller 200 executes a center process routine illustrated in FIG. 20. The main CPU 241 performs the center process routine to run a bonus game.

As illustrated in FIG. 20, the main CPU 241 determines, in the center process routine, whether a jackpot signal is received from the slot machine 10 (E1). When it is determined that a jackpot signal is received (E1: YES), a game value indicated by the jackpot signal is cumulatively stored (E2). The process is then brought back to E1.

Meanwhile, in step E1, when the main CPU 241 determines that no jackpot signal is received (E1: NO), it determines whether the jackpot equals or surpasses a predetermined value (E3). When it is determined that the jackpot equals or surpasses the predetermined value (E3: YES), a bonus game start signal is outputted to each slot machine 10 (E4). Step E1 is executed next.

Meanwhile, when it is determined that the jackpot is smaller than the predetermined value (E3: NO), the main CPU 241 determines whether a winning signal is received from the terminal controller 100 (E5). When it is determined that no winning signal is received (E5: NO), the process is brought back to step E1. Meanwhile, when it is determined that a winning signal is received (E5: YES), all the common game light emitting portions 320 are caused to emit light in the same color, the common game light emitting portions 320 provided to an illuminating board 310 of the illumination device 300 serving as the bonus payout display unit 300. Next, the main CPU 241 determines a random number based on the path unit activation state table (E6). The main CPU 241 then updates the path unit activation state table based on the random number determined (E7). The main CPU 241 then activates the number of light emitting portions 403 towards the bonus payout display unit 300, the number equivalent to the random number determined (E8).

Next, it is determined whether there is any path unit 401 whose light emitting portions 403 have been activated up to the bonus payout display unit 300, in order to determine whether conditions for awarding a bonus payout are satisfied (E9). When it is determined that the conditions for awarding a bonus payout are not satisfied (E10: NO), the process is brought back to E1. Meanwhile, when it is determined that the conditions for awarding a bonus payout are satisfied (E10: YES), the main CPU 241 causes each of the common game light emitting portions 320 to emit light in a different color, the common game light emitting portions 320 provided to the illuminating board 310 of the illumination device 300 serving as the bonus payout display unit 300. Then, a bonus award process is executed to award a bonus payout, and a bonus award signal is outputted to the slot machine 10 subject to the bonus payout (E10). Then, a subtraction of the amount of jackpot value consumed is performed in the RAM 243 (E11), and a bonus game end signal is outputted to each slot machine 10 (E12). The process is then brought back to E1.

Note that in the present embodiment, reset of the light emission control unit 74 is triggered by a predetermined input from outside. The present invention, however, is not limited to this. For example, the present invention may additionally include a function of automatically detecting an error in the light emission control unit 74 and automatically resetting the light emission control unit 74. The following describes an example of automatic detection of error in the light emission control unit 74, with reference to FIG. 21. Note that the members same as those in the previous embodiment are given the same numerals as those given to the corresponding members in the previous embodiment, and descriptions of them may be omitted.

Specifically, in addition to the first and the second structures, the gaming machine 1 may possess a third structure where (i) the gaming machine 1 further includes a detection unit 77 which detects a lighting mode of the light emitting portion 79, (ii) the terminal controller 100 determines whether a lighting mode associated with a game state differs from the lighting mode of the light emitting portion 79 detected by the detection unit 77, and (iii) when the detection unit 77 detects a difference, the terminal controller 100 instructs the light emission power control unit 76 to reset power supply.

According to the above structure, power supply to the light emission control unit 74 is resettable while a game is in progress. Further, the light emission control unit 74 is resettable without halting the game, even when an error occurs in the light emitting portion 79 or the light emission control unit 74. Thus, it is possible to show a player who plays a game that the gaming machine 1 is capable of resetting the light emission control unit 74 alone, while retaining data and the like of the game. This prevents decrease in credibility of the gaming machine 1 and the administrator thereof with the player. Further, the actual lighting mode is detected and when it is determined that the actual mode differs from a lighting mode associated with a game state, the power supply to the light emission control unit 74 is reset. Accordingly, it is possible to automatically rectify an error in the light emitting portion 79. As a result, it is possible to prevent deterioration in the entertainment characteristic caused by an error in a light emitting device 70.

Figure 21:
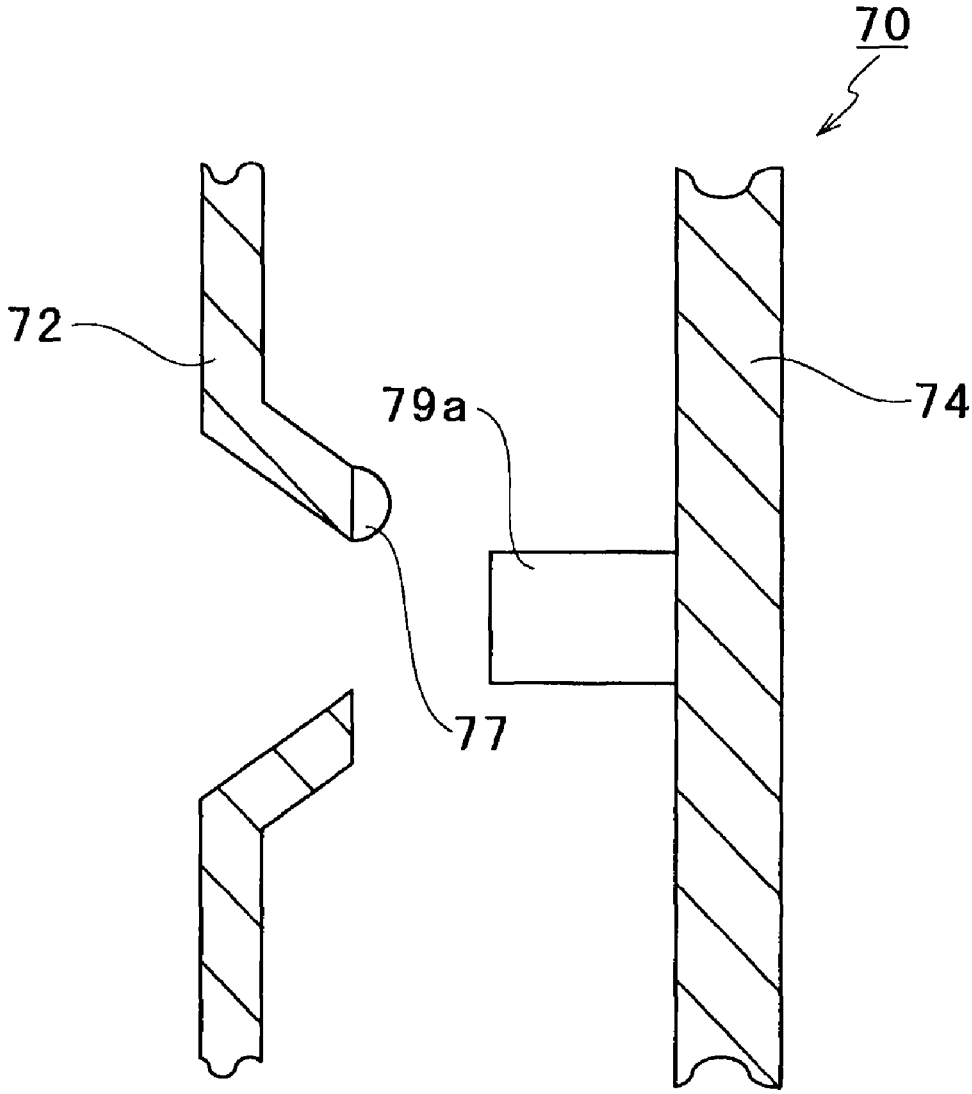
FIG. 21 is a schematic diagram illustrating a partial magnified view of the light emitting device.

FIG. 21 is a schematic diagram illustrating a partial magnified view of the light emitting device 70. The light emitting device 70 is provided with detection units 77 each at a portion of the exterior member 72, the portion corresponding to a light emitting element 79*a* provided on a front face of the substrate of the light emission control unit 74, as illustrated in FIG. 21. The detection units 77 each are connected to the main body PCB 60, and has an optical sensor capable of detecting the intensity of light. The detection units 77 each determine an intensity of light detected by the optical sensor. In other words, each of the detection units 77 outputs a signal to the main CPU 41 when the intensity of light emitted by the corresponding one of the light emitting elements 79*a* equals or exceeds the predetermined threshold value, the signal indicating that the light emitting element 79*a* is on. Further, each of the detection units 77 outputs a signal to the main CPU 41 when the intensity of light emitted by the corresponding one of the light emitting elements 79*a* is lower than the predetermined threshold value, the signal indicating that the light emitting element 79*a* is off.

The main CPU 41 of the slot machine 10 determines, at a predetermined timing, whether the lighting mode associated with a game state differs from the lighting mode based on a signal from the detection unit 77. When the main CPU 41 determines that there is a difference, it executes an automatic reset process which resets power supply to the light emission control unit 74.

Specifically, the main CPU 41 of the slot machine 10 determines the lighting mode based on a signal from the detection unit 77, at a timing that the lighting mode of all the light emitting elements 79*a* are changed to "0," that is, all the light emitting elements 79*a* are turned off. When the main CPU 41 determines that all the light emitting elements 79*a* are off, the automatic reset process ends.

Meanwhile, when the main CPU 41 determines based on an signal from the detection unit 77 that any one of the light emitting elements 79*a* is on, the main CPU 41 executes the same process as that of steps F2 to F7 of a reset process of FIG. 19 to reset the light emission control unit 74.

Thus, the slot machine 10 is capable of resetting power supply to the light emission control unit 74 when an actual lighting mode detected is determined to be different from the lighting mode associated with a game state of the base game. Accordingly, it is possible for the slot machine 10 to automatically rectify an error in the light emitting portion 79. As a result, it is possible to prevent deterioration in the entertainment characteristic caused by an error in the light emitting device 70.

Note that detection of on or off of the light emitting elements 79*a* by the detection unit 77 is not limited to one utilizing a optical sensor. For example, the detection may be made by monitoring a voltage or the like of each light emitting element 79*a*.

The detailed description of the present invention provided hereinabove mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious to those skilled in the art that the other structures, systems, methods and the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer or computer network. The above descriptions and expressions are provided to allow one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, term, number, or the like solely for the sake of convenience. Although the present specification occasionally personifies the processes performed in the steps or blocks, these processes are essentially executed by various devices. Further, the other structures necessary for the steps or blocks are obvious from the above descriptions.

The present invention is applicable to gaming machines in general such as a gaming machine having a light emitting device.

What is claimed is:

1. A gaming machine comprising:

a light emitting portion which emits light;

a game controller which runs a game;

a light emission control unit which causes the light emitting portion to emit light, and controls the light emitting portion in such a manner that the light emitting portion emit lights in a lighting mode associated with a game state;

a power supply unit which supplies power to the light emission control unit and the game controller, separately;

an input device through which a predetermined input can be externally inputted;

a light emission power control unit which controls, in response to the predetermined input, power supplied from the power supply unit to the light emission control unit in a resettable manner, while the game controller is running the game; and a detection unit which detects a lighting mode of the light emitting portion, wherein the game controller:

(i) determines, at a predetermined timing, whether a lighting mode associated with a game state differs from a lighting mode detected by the detection unit; and (ii) when a difference is detected, instructs the light emission power control unit to reset power supplied to the light emission power control unit.

2. The gaming machine according to claim 1, wherein the light emission control unit is capable of controlling the light emitting portion in such a manner that the light emitting portion emits light in a predetermined lighting mode, when power is not supplied from the power supply unit to the game controller.

3. The gaming machine according to claim 1, wherein the gaming machine includes a display for displaying the game, and when the light emission power control unit is reset, a notification of a reset of the light emitting portion is displayed on the display.

* * * * *